US006006052A

United States Patent [19]

Kamimura et al.

[11] Patent Number: 6,006,052

[45] Date of Patent: Dec. 21, 1999

[54] FIXING METHOD AND FIXING DEVICE

[75] Inventors: Taisuke Kamimura, Kitakatsuragi-gun; Toshiaki Kagawa, Sakurai, both of Japan

[73] Assignee: Sharp Kabushiki Kaisha, Osaka, Japan

[21] Appl. No.: 09/220,880

[22] Filed: Dec. 23, 1998

[30] Foreign Application Priority Data

Jan. 16, 1998 [JP] Japan ..... 10-007036

[51] Int. Cl.[6] ..... G03G 15/20

[52] U.S. Cl. ..... 399/69; 399/324; 399/328

[58] Field of Search ..... 399/69, 70, 320, 399/324, 328, 329, 330, 331; 219/216, 469, 470, 471

[56] References Cited

U.S. PATENT DOCUMENTS

| | | | |
|---|---|---|---|
| 4,977,431 | 12/1990 | Fuji | 399/69 |
| 5,321,481 | 6/1994 | Mathers | 399/69 |
| 5,436,430 | 7/1995 | Baruch et al. | 399/69 X |
| 5,448,339 | 9/1995 | Kokaji et al. | 399/69 |
| 5,847,361 | 12/1998 | Yonekawa et al. | 399/69 X |

OTHER PUBLICATIONS

35th Technology Workshop organized by Electrophotographic Institute, ( Jun. 29–30, 1993), pp. 84 to 85 (Translation of passages related to claims 1, 9 and 24).

*Primary Examiner*—Arthur T. Grimley
*Assistant Examiner*—Hoan Tran
*Attorney, Agent, or Firm*—David G. Conlin; David A. Tucker

[57] ABSTRACT

A fixing method for fixing an unfixed toner image formed on a recording material by transporting the recording material to a contact portion between a fixing roller and a pressurizing mechanism for pressurizing the surface of the fixing roller is arranged such that the fixing roller surface temperature and the pressurizing mechanism surface temperature at the contact portion while the recording material is being transported therethrough are controlled to fall within a non-offset region in which a sufficient fixing strength for fixing toner onto the recording material can be ensured without generating a high temperature offset, said non-offset region being defined by a critical border line obtained from a function of a fixing roller surface temperature and a pressurizing mechanism surface temperature. According to the described fixing method, an occurrence of an offset can be prevented without an application of an oil, and a toner fixing inferior can be prevented.

24 Claims, 9 Drawing Sheets

FIXING METHOD AND FIXING DEVICE

FIELD OF THE INVENTION

The present invention relates to a fixing method and a fixing device for use in electrophotographic printing apparatuses utilizing an electrophotographic process such as copying machines, facsimiles, printers, etc., and particularly relates to a fixing method and a fixing device for use in electrophotographic apparatuses which permit full-color printing.

BACKGROUND OF THE INVENTION

Conventionally, for fixing devices for use in electrophotographic apparatus adopting electrophotographic processes such as copying machines, facsimiles, printers, etc., an internal heating process is generally adopted wherein a sheet having unfixed toner thereto is inserted into a contact portion (fixing section) between a fixing roller having stored therein a heater and a pressurizing roller which comes in tight contact with the fixing roller, and the toner is melted under an applied heat, thereby making the toner permanently affixed onto the sheet.

A schematic structure of the conventional fixing device adopting the described internal heating system is shown in FIG. 11. The fixing device is structured, for example, so as to include a fixing roller 101 having a silicone rubber layer 101*b* laminated on a core metal 101*a* made of aluminum and a pressurizing roller 102 having a silicone rubber layer 102*b* formed on a core metal 102*a* made of aluminum, wherein the pressurizing roller 102 is made in contact with the fixing roller 101.

The fixing roller 101 stores therein a heater lamp 103 as a heat source. The fixing roller 101 applies heat from the inside based on a result of detection by a thermistor 104 mounted on the surface of the fixing roller 101 to heat the surface of the fixing roller 101 to a predetermined temperature to be ready for a fixing operation (hereinafter referred to as a warm-up time).

On the other hand, the pressurizing roller 102 rotates while maintaining a contact with the fixing roller 101 during the warm-up time. Therefore, the pressurizing roller 102 is indirectly heated by the fixing roller 101. Therefore, the toner T on the sheet P as being transported to the contact portion between the fixing roller 101 and the pressuring roller 102 is heated by both the fixing roller 101 and the pressurizing roller 102, whereby the toner T is made permanently affixed onto the sheet P.

However, in the case of fixing the toner T onto the sheet P by the fixing device adopting the described internal heating method, for example, in the case of adopting toner which does not have desirable release properties such as color toner, etc., the toner may adhere to the surface of the fusing roller 101 (a so-called offset) in the fixing process. Namely, in order to improve color development or transparency of the color toner, it is required to set the fixing temperature high so as to apply a large amount of heat energy to the color toner formed on a multi-layer. However, when the temperature of the fixing roller 101 is increased so as to separate the toner T from the fixing roller 101 in a highly melted state, the adhesive exerted between the fixing roller 101 and the toner T exceeds the internal agglomeration force, and the toner T is parted in its inside, which results in an offset. On the other hand, when an attempt is made to prevent the high temperature offset by lowering the fixing temperature, the fixing strength on the interface between the toner T and the sheet P can be reduced, which results in insufficient fixing strength.

In order to counteract the described problem, especially, in the fixing device of the internal heating system adopting the full-color electrophotographic process, the fixing roller 101 is maintained at high temperature (for example, at around 180° C.), and an offset-prevention-use oil 106 is applied onto the surface of the fixing roller 101 by means of an oil application mechanism 105 provided with a pair of oil application rollers 107, and after making the toner T affixed onto the sheet P, the sheet P is removed from the fixing roller 101 by a separation claw 108, whereby the sheet P having the toner T affixed thereon is removed from the fixing roller 101.

However, in the case of applying the offset-prevention-use oil 106 to the surface of the fixing roller 101, the following problems arise:

(1) A complicated structure is needed for uniformly applying the oil 106 to the fixing roller 101, which results in an increase in a cost for the fixing device;

(2) The silicone rubber layer 101*b* of the fixing roller 101 deteriorates and swells with an application of the oil 106, which results in a shorter life of the fixing roller 101;

(3) The device is contaminated by the leakage of the oil 106 which adversely affects other devices;

(4) The oil 106 may adhere to the sheet P, which makes the user's hands dirty and makes him uncomfortable;

(5) In the case of adopting the OHP to the sheet P, the oil 106 adheres onto the surface of the OHP, which results in poor transparency of the OHP is lowered; and (6) A periodical maintenance is required such as a supply of the oil 106, etc., and thus it is inconvenient to use.

Moreover, in the conventional fixing device, the fixing roller 101 of a large heat capacity is heated by the heater lamp 103 (for example, 800 W) stored therein, and a heat is transferred from the surface of the fixing roller 101 to the pressurizing roller 102. As a result, the pressurizing roller 102 is also heated when heating the fixing roller 101. Namely, in the conventional fixing device of the internal heating system, most of heat applied to the fixing roller 101 is absorbed by the pressurizing roller 102. Therefore, in the described fixing device of the internal pressurizing system, a long warp-up time is required for heating the surface of the fixing roller 101 to temperatures at which the toner T can be fixed.

SUMMARY OF THE INVENTION

It is an object of the present invention to provide a fixing method and a fixing device which prevent an occurrence of an offset without requiring an application of an oil, and reduce an fixing inferior of the toner.

In order to achieve the above object, a fixing method for fixing an unfixed toner image formed on a recording material by transporting a recording material having formed thereon an unfixed toner image to a contact portion between fixing means and pressurizing means for pressurizing a surface of the fixing means, is characterized by including the steps of:

(i) obtaining beforehand a non-offset region defined by a critical border line obtained from a function of a fixing means surface temperature and a pressurizing means surface temperature in which a sufficient fixing strength for fixing toner onto the recording material can be ensured without generating a high temperature offset; and (ii) controlling the fixing means surface temperature and the pressurizing means surface temperature at the contact portion while the recording material is being transported therethrough to fall within the non-offset region.

According to the described arrangement, by controlling the surface temperature of the fixing means and the surface temperature of the pressurizing means to fall within the non-offset region, an occurrence of an offset can be prevented without using the offset-prevention-use oil, and a fixing inferior of the toner can be reduced.

Namely, in the conventional method, the surface temperature of the pressurizing means, particularly, the relationship between the surface temperature of the fixing means and the surface temperature of the pressurizing means have not been considered. Therefore, in the conventional method, the pressurizing means is heated as the surface temperature of the fixing means is raised, and a fixing operation is performed in the region beyond the non-offset region. However, as a result of studies performed by the inventors, it becomes clear that there exits the critical border line obtained from the function of the surface temperature of the fixing means and the surface temperature of the pressurizing means. Therefore, by carrying out the temperature control based on the critical border line, a quality image can be formed without adopting the offset prevention-use oil.

In order to achieve the above object, the fixing device of the present invention is arranged so as to include:

fixing means;

pressurizing means for pressurizing a surface of the fixing means;

heating means for heating the fixing means;

first temperature detection means for detecting a surface temperature of the fixing means in a vicinity of the contact portion, the first temperature detection means being provided in a vicinity of the contact portion of the fixing means;

second temperature detection means for detecting a surface temperature of the pressurizing means in a vicinity of the contact portion, the second detection means being provided in a vicinity of the contact portion of the pressurizing means; and heat application control means for controlling the heating means based on results of detection by the first temperature detection means and the second temperature detection means, wherein the heat application control means controls the fixing means surface temperature and the pressurizing means surface temperature at the contact portion while the recording material is being transported therethrough within a non-offset region in which a sufficient fixing strength for fixing toner onto the recording material can be ensured without generating a high temperature offset, the non-offset region being defined by a critical border line obtained from a function of a fixing means surface temperature and a pressurizing means surface temperature.

According to the described arrangement, by controlling the surface temperature of the fixing means and the surface temperature of the pressurizing means within the non-offset region, an occurrence of the offset can be prevented without using the offset prevention use oil, and a fixing inferior of the toner can be reduced.

For a fuller understanding of the nature and advantages of the invention, reference should be made to the ensuing detailed description taken in conjunction with the accompanying drawings.

DESCRIPTION OF THE EMBODIMENTS

First Embodiment

Figure 1:
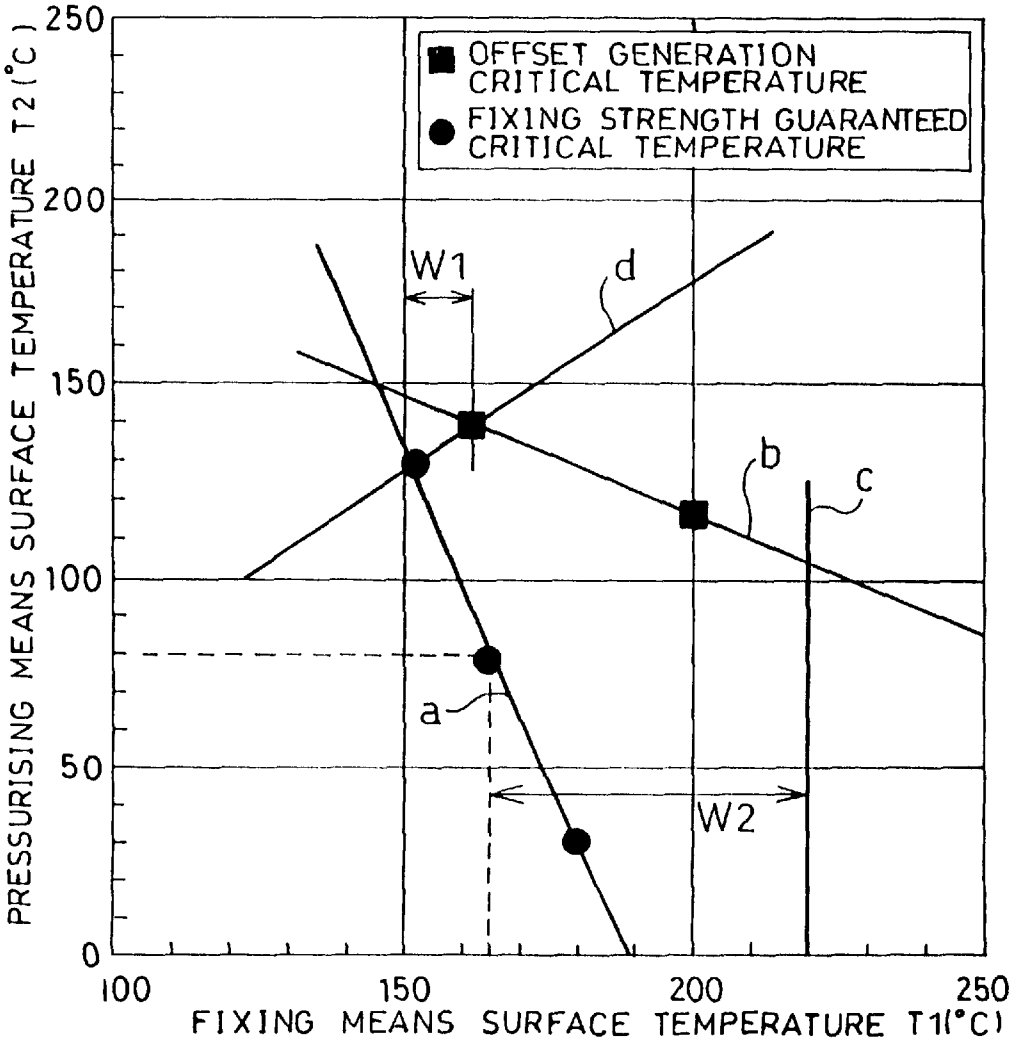
FIG. 1 is a fixing strength/high temperature offset characteristic diagram in accordance with one embodiment of the present invention.

The following descriptions will explain one embodiment of the present invention in reference to FIG. 1 through FIG. 6.

Various studies have been made by inventors including inventors of the present invention to find a solution to an offset and a fixing inferior of the toner in the fixing device adopting the internal heating system in the electrophotographic process. As a result, they have found that when the fixing temperature is raised to attain improved color development and transparency and to remove the toner from the fixing device (for example, fixing roller) in a highly melted state, there exists border lines indicative of critical points defined by the function of the surface temperature of the fixing means and the surface temperature of the pressurizing means at the contact portion (fixing nip portion) between the fixing means and the pressurizing means (for example, pressurizing mechanism to be described later), beyond which ① the adhesive force between the fixing roller and the toner exceeds the internal agglomeration force, ② the toner is parted in its inside, and ③ an offset (high temperature offset) occurs.

As a result of further investigations, the inventors including the inventors of the present invention have also found that there exists a border line indicative of critical points defined by the function of the surface temperature of the fixing means and the surface temperature of the pressurizing means at the contact portion (fixing nip portion) between the fixing means and the pressurizing means (for example, pressurizing mechanism to be described later), beyond which the adhesive on the interface between the toner and the recording material is lowered, and a sufficient fixing strength cannot be obtained. In the present invention, a sufficient fixing strength suggests that a desirable result can be obtained by the bending test (to be described later), and that in practical use, the drop of the toner is hardly observed.

In view of the above, inventors of the present invention have studied to find a desirable method of transferring heat to the toner from the fixing means and the pressurizing means by specifying the temperatures of the toner at which the toner can adhere to the sheet, and a sufficient fixing strength can be obtained without generating a high temperature offset.

The desirable temperature conditions of the toner at which the toner can be affixed to the sheet, and a sufficient fixing strength can be obtained without generating a high temperature offset will be explained in reference to FIG. 1.

Experiments are performed to find the relationship between a fixing means surface temperature T1 (°C.) and a pressuring means surface temperature T2 (°C.) at which the toner can adhere to the sheet, and a sufficient fixing strength can be obtained without generating a high temperature offset. For the experiments, for example, a fixing roller and a pressurizing mechanism to be described later can be used as the fixing means and the pressurizing means respectively. For the toner, for example, a Sharp JX 8200 is used.

From combinations of the fixing means surface temperature T1 and the pressuring means surface temperature T2, fixing strength guaranteed critical temperatures for the toner to adhere to the recording material and high temperature offset generation critical temperatures for preventing a high temperature offset are plotted respectively, and are approximated to linear lines.

As a result, from the fixing strength guaranteed critical temperature, the first critical border line a (fixing strength guaranteed critical border line) shown by the following formula (a) for ensuring a sufficient strength between the toner and the recording material can be derived:

$$T2 \geqq -3.3 \times T1 + 625(°C.) \quad (a).$$

From the high temperature offset generation critical temperature, the second critical border line b (high temperature offset occurrence critical border line) shown by the following formula (b) for preventing a high temperature offset can be derived:

$$T2 \leqq -0.5 \times T1 + 220(°C.) \quad (b).$$

Namely, the temperature region shown in FIG. 1 which is enclosed by the first critical border line shown by the formula (a) and the second critical border line shown by the formula (b) is the region (hereinafter referred to as a non-offset region) where when adopting the described toner, a sufficient strength can be ensured without generating a high temperature offset obtained from the above experiments.

Next, based on the simulation of transferring heat, the temperatures of the toner on the first critical border line a and the second critical border line b are obtained from the fixing means surface temperature T1 and the pressurizing means surface temperature T2. As a result, it has been found that the first critical border line a indicates a border at which the temperature of the interface between the recording material and the toner is t1 °C., and the second critical border line b indicates a border at which the temperature of the border between the toner and the fixing means is t2 °C. Namely, the region surrounded by the first critical border line a and the second critical border line b is the region which satisfies the condition of t1 °C.≦absolute temperature of toner≦t2 °C.

From the above, it can be seen that the desirable temperature condition of the toner is t1 °C.≦absolute temperature of toner≦t2 °C. Therefore, a desirable heat application to the toner can be obtained by controlling the fixing means surface temperature T1 and the pressurizing means surface temperature T2 at the contact portion between the fixing means and the pressurizing means to fall within the non-offset region defined by the border lines including the first critical border line a and the second critical border line b. Namely, by controlling the fixing means surface temperature T1 and the pressurizing means surface temperature T2 so as to fall within the described non-offset region, a desirable application of heat to the toner can be achieved. Therefore, an offset can be prevented without an application of oil like the conventional method, and a toner fixing inferior can be reduced.

Therefore, in order to control the fixing means surface temperature T1 and the pressuring means surface temperature T2 so as to fall within the non-offset region, it is desirable to control the fixing means surface temperature T1 and the pressurizing means surface temperature T2 to temperatures at around the center line between the first critical border line a and the second critical border line b, i.e., to the temperatures in a vicinity of a line obtained by plotting values of fixing strength guaranteed temperature+high temperature offset generation critical temperature)/1 based on the first critical border line a and the second critical border line b in the non-offset region. This is because even in the case of large variations in the fixing means surface temperature T1 or the pressurizing means surface temperature T2 or the environmental temperature, the fixing means surface temperature T1 and the pressuring mean surface temperature T2 can be stably controlled to fall within the non-offset region under stable conditions.

Here, as the offset generation critical temperature and the fixing strength guaranteed temperature of the toner differ depending on the kinds of toner, it is required to set the first critical border line a and the second critical border line b for each kind of toner.

Additionally, when controlling the fixing means surface temperature T1 and the pressuring means surface temperature T2 so as to fall within the non-offset region, in consideration of the thermal deterioration of the fixing means, it is preferable that the fixing means surface temperature T1 be controlled so as to satisfy the following condition (c), as a still stable fixing operation can be performed:

$$T1 \leqq 220(°C.) \quad (c).$$

Namely, by maintaining the fixing means surface temperature T1 and the pressurizing means surface temperature T2 so as to fall in the region surrounded not only by the first critical border line a and the second critical border line b, but also by the third critical border line c (critical border line shown by the formula (c), the offset can be prevented, and the fixing inferior of the toner can be reduced, and a desirable fixing operation can be performed by preventing the thermal deterioration of the fixing means.

In contract, in the conventional fixing device adopting the internal heating system, during a warm-up time until a fixing operation can be performed, as the heat is transferred from the fixing roller heated to a predetermined temperature to the pressuring roller, and the surface temperature of the pressuring roller follows the surface temperature of the fixing roller, heat is applied to the recording material having formed thereon an unfixed toner image both from the fixing roller and the pressuring roller.

Therefore, the temperature characteristics of the fixing roller (fixing means) and the pressuring roller (pressuring means) in the conventional internal heat application system are as shown by the line d in FIG. 1 which is obtained by the following formula (d):

Pressuring means surface temperature T2 = 1 x fixing means surface temperature T1 - 20 (°C.) . . . (d).

The above formula (a) can be rewritten into:

Pressuring Means Surface Temperature T2/Fixing Means Surface Temperature T1=Temperature Gradient k, wherein an upsurge temperature gradient of k=1 is obtained.

As described, in the conventional internal heating method, the surface temperature of the pressuring roller, particularly, the relationship between the surface temperature of the fixing roller and the surface temperature of the pressuring roller (i.e., the correlation between the fixing means surface temperature T1 and the pressuring means surface temperature T2) is not particularly considered. In the conventional method, in order to supply a large amount of heat energy to the toner, the fixing roller is heated to high temperature (for example, 180° C.), and the surface of the pressuring roller follows the surface of the fixing roller held at high temperature, and a fixing operation is performed under the conditions that the respective surfaces of the rollers are heated beyond the non-offset region. Therefore, in the conventional fixing device adopting the conventional internal heat application system, in order to prevent the offset, the oil application mechanism is required.

In order to contract the described problems, the present invention controls the fixing means surface temperature T1 and the pressuring means surface temperature T2 so as to fall within the non-offset region. As a result, an oil application mechanism can be eliminated, and a simplified structure can be obtained.

In the fixing device adopting the conventional internal heat application system, as the surface temperature of the pressuring roller is raised as the surface of the fixing roller is heated, if an attempt is made to apply the present invention to the conventional heat application system, a permissible temperature range W1 of the fixing roller which can be set within the non-offset region would be around 10 deg.

However, in consideration of the operable environmental temperature range of 5° C. to 35° C., the permissible temperature range of the fixing means is 30 deg.

The inventors including the inventors of the present application have studied on the fixing device to which the fixing method of the present invention can be applied.

Hereinafter, the structure of the fixing device adopting the fixing method and the fixing method adopting the fixing device will be explained. In the present embodiment, explanations will be given through the case where the fixing device is applied to a monochrome laser printer as an example of the electrophotographic apparatus.

Figure 3:
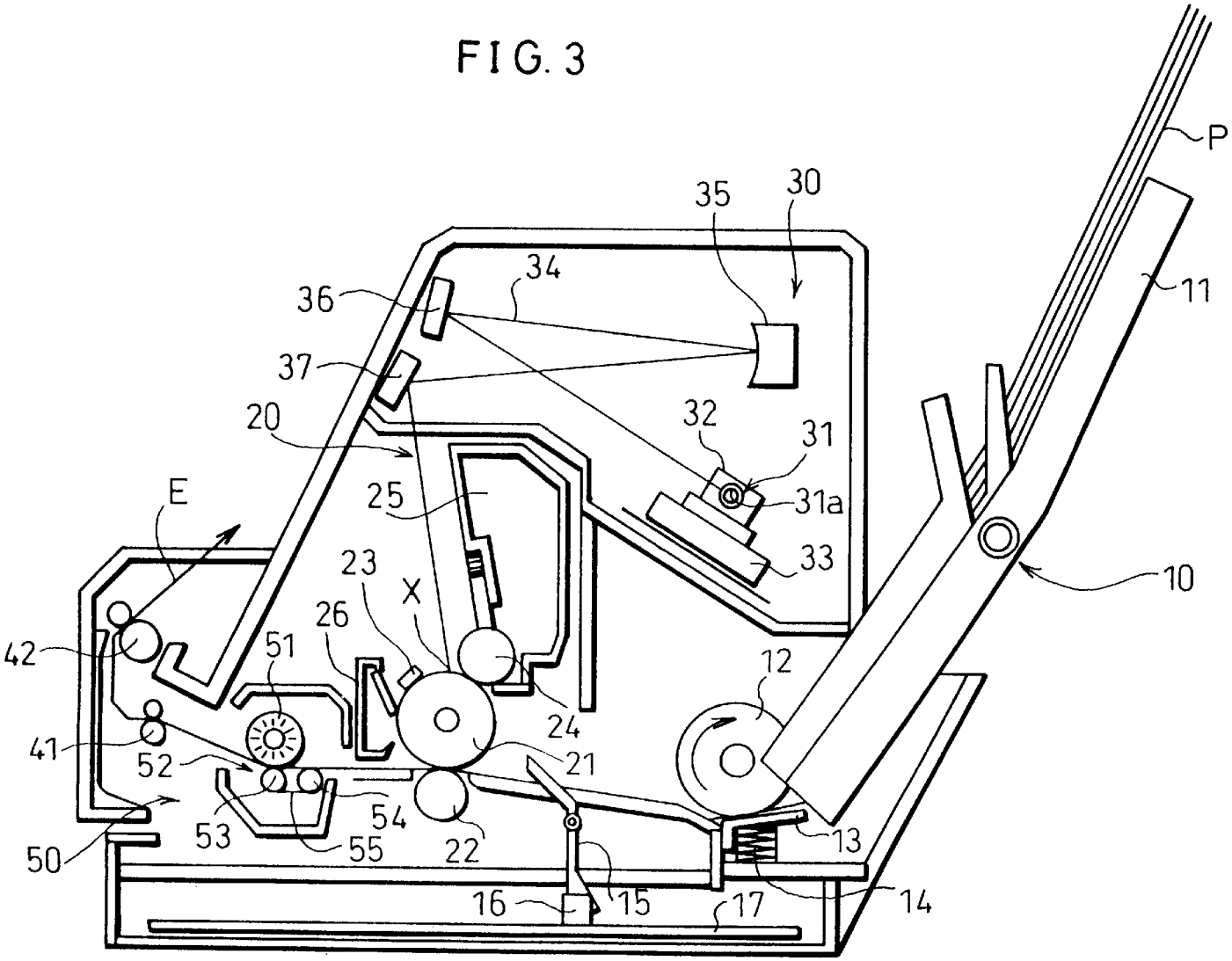
FIG. 3 is a diagram schematically showing a laser printer provided with the fixing device in accordance with one embodiment of the present invention.

As shown in FIG. 3, the laser printer in accordance with the present embodiment includes a feed section 10, an image forming device 20, a laser scanning section 30 and a fixing device 50.

The laser printer of the described arrangement transfers a sheet P (recording material) from the feed section 10 to the image forming device 20. The image forming device 20 is arranged so as to form a toner image based on the laser light by the laser scanning section 30, and the resulting toner image is transferred to the sheet P as transported. The sheet P having a toner image transferred thereto is transported to the fixing device 50 where a toner image is made permanently affixed to the sheet P. Lastly, the sheet P having a toner image affixed thereto is discharged outside the external section by the sheet transport rollers 41 and 42 provided in the downstream side in the sheet transport direction of the fixing device 50. Namely, the sheet P is transported to a feed tray 11, the image forming device 20 and the fixing device 50 in order along the path in a direction of an arrow E shown in FIG. 3 to be discharged outside the device.

The sheet feed section 10 includes the feed tray 11, a feed roller 12, a sheet separation friction plate 13, a pressurizing spring 14, a sheet detection actuator 15, a sheet detection sensor 16 and a control circuit 17. In the preferred embodiment, the control circuit 17 performs an entire control of respective elements provided in the laser printer.

The feed tray 11 can store a plurality of sheets P. By rotating in the direction of an arrow, the feed roller 12 transports the sheet P set on the feed tray 11 to the side of the image forming device 20. Here, the sheet separation friction plate 13 is pressurized onto the feed roller 12 by the pressurizing spring 14, and a plurality of sheets P mounted to the feed tray 11 are separated sheet by sheet.

The sheet detection sensor 16 is, for example, made of an optical sensor, and the sheet detection actuator 15 is made of a member which is capable of tilting in a sheet transport direction by the sheet P transported by the feed roller 12. Namely, in the state where the sheet detection actuator 15 is not tilted, the sheet detection sensor 16 shuts off a light path and thus shows an OFF state, while in the state where the sheet detection actuator 15 is tilted, an optical path is formed to indicate the ON state.

The control circuit 17 sends an image signal to a laser diode emitting unit 31 of the laser scanning section 30 based on the detection signal from the sheet detection sensor 16 to control ON/OFF of the light emitting diode 31*a*.

The laser scanning section 30 includes a laser diode emitting unit 31, a scanning mirror 32, a scanning mirror motor 33, and reflection mirrors 35, 36 and 37.

The scanning mirror motor 33 is provided under the scanning mirror 32 so as to rotate the scanning mirror 32 at high speed and at a fixed rate. Additionally, the laser diode emitting unit 31 is provided on the scanning mirror 32 so as to rotate with the scanning mirror 32. Namely, the laser diode emitting unit 31 projects the laser light from the light emitting diode 31*a* onto the reflecting mirror 36 while rotating with the scanning mirror 32 at high and at constant speed.

The laser light 34 is reflected from the reflection mirrors 36, 35 and 37, and is directed onto the exposure point X of the image forming device 20. At the exposure point X, the laser light 34 scans in a direction perpendicular to the sheet transport direction, and based on the data of the ON/OFF from the control circuit 17, the photoreceptor 21 of the image forming device 20 is selectively exposed.

The image forming device 20 includes the photoreceptor 21, the transfer roller 22, the charge member 23, the developer roller 24, the developer unit 25 and the cleaning unit 26.

The photoreceptor 21 is arranged such that the charges which are charged on the surface of the charge member 23 beforehand are selectively discharged by the laser light 34 from the laser scanning section 30 so as to form an electrostatic latent image on the surface thereof.

The developer unit 25 includes a developer roller 24 for supplying a toner to the photoreceptor 21, and by stirring the toner stored in the inside, charges are applied to the toner so as to make the toner adhere to the surface of the developer roller 24. Then, by the function of the electric field formed by a developer bias voltage applied to the developer roller 24 and a potential on the surface of the photoreceptor 21, a toner image corresponding to an electrostatic latent image formed on the surface of the photoreceptor is formed on the photoreceptor 21.

In the image forming device 20, by the function of the electric field of the transfer voltage applied to the transfer roller, the toner is attracted onto the sheet P transported between the photoreceptor 21 and the transfer roller 22, and the toner is transferred onto the sheet P. Here, the toner on the photoreceptor 21 is transferred to the sheet P by the transfer roller 22, and the toner remained untransferred is collected by the cleaning unit 26.

In the image forming device 20, the sheet P having the toner image transferred thereto is transported to the fixing device 50, and the toner image is made permanently affixed thereto. Namely, in the fixing device 50, appropriate temperature and pressure are applied to the sheet P by a fixing roller 51 and the heat insulating pressurizing roller 53 via a pressurizing belt 55 which is stretched by the pressurizing roller 53 and the support roller (pressurizing belt support roller)54 and the entire surface is maintained at low temperatures. The surface of the fixing roller 51 is maintained at high temperatures. After the toner is melted under an applied heat, the toner is cooled off to be affixed onto the sheet P to be a firm image. Then, in the fixing device 50, the sheet P having a toner image formed thereon is transported to the outside of the apparatus by the sheet transport rollers 41 and 42 provided on the sheet side of the fixing device 50.

In reference to FIG. 4, the fixing device 50 in accordance with the present embodiment will be explained in detail.

Figure 4:
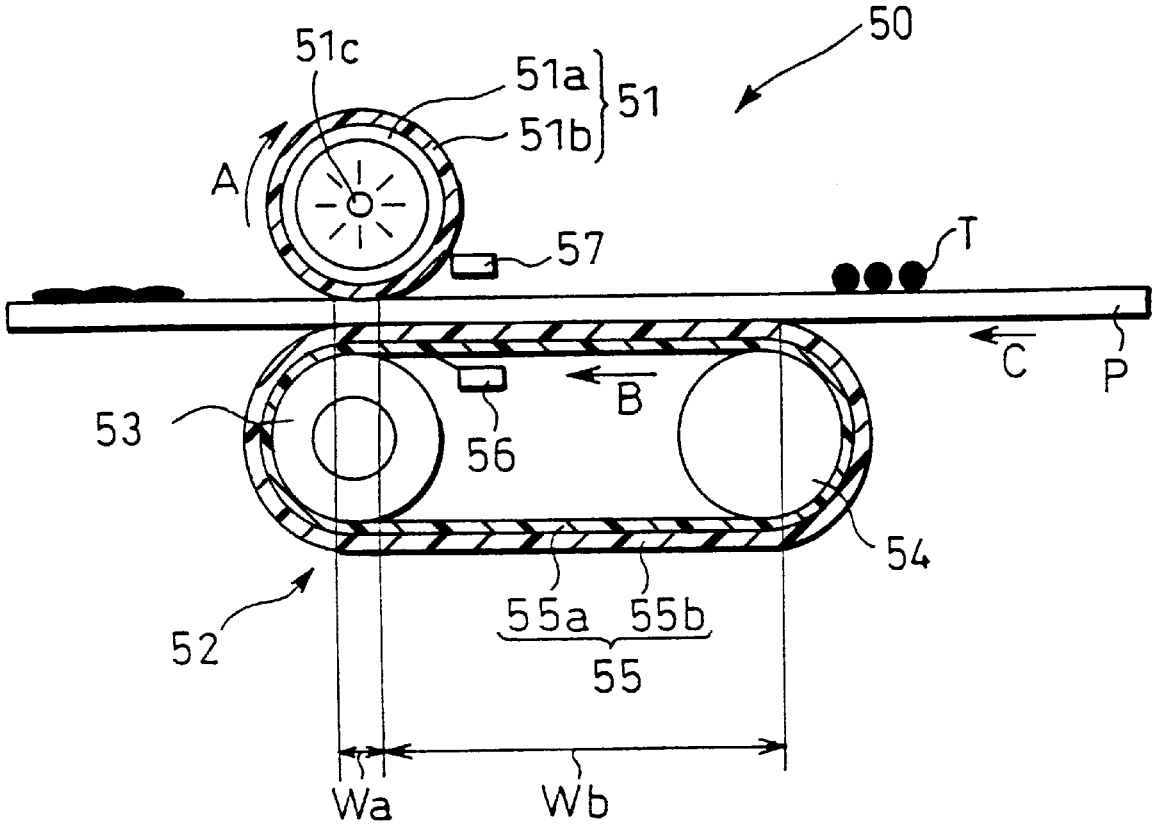
FIG. 4 is a diagram schematically showing the fixing device shown in FIG. 3.

As shown in FIG. 4, the fixing device 50 includes the fixing roller 51 serving as fixing means and pressurizing mechanism 52 serving as pressurizing means.

The pressurizing mechanism 52 includes the pressurizing roller 53 provided in parallel to the fixing roller 51, the support roller 54 provided on the upstream side in the transport direction of the sheet P than the pressurizing roller 53, and a pressurizing endless belt (hereinafter simply referred to as a pressuring belt) 55 stretched by a predetermined extension force by these rollers (pressurizing roller 53 and the support roller 45).

The pressurizing belt 55 is provided for forming a contact portion (fixing nip section) by being pressed onto the outer surface of the fixing roller 51 by the pressurizing roller 53 with a predetermined pressurizing force. Then, by the pressurizing roller 53 and the support roller 54, the pressurizing belt 55 is stretched to the outside of the contact portion serving as a heat receiving section, and a sufficient heat releasing region for releasing the heat as received by the contact with the fixing roller 51 in the contact portion is formed. In the pressurizing belt 55, the region outside the contact portion corresponds to the heat releasing region.

In the fixing device 50, the surface temperature T1 of the fixing roller 51 (fixing means surface temperature T1) and the surface temperature T2 of the pressurizing belt 55 (i.e., the pressurizing means surface temperature T2) can be controlled by the various methods to fall within the temperature region defined by the fixing strength guaranteed border line a and the offset generation critical border line b in the fixing strength/high temperature offset characteristics diagram shown in FIG. 1, i.e., the non-offset region defined by ① the first critical border line a indicative of the temperature on the interface between the recording material and the toner which offers a sufficient strength by contacting the toner and the recording material and ② the second critical border line b indicative of the interface temperature between the fixing means and the toner without generating the high temperature offset which are the critical border lines resulting from the function between the fixing means surface temperature T1 and the pressurizing means surface temperature T2.

The simplest method of setting the length of the circumference of the pressuring belt 55 is that in the case where the surface temperature T1 of the fixing roller 51 is controlled within the region defined by the fixing strength guaranteed critical border line a and the offset generation guaranteed critical border line b in the fixing strength/high temperature offset characteristic diagram, the surface temperature T2 of the pressurizing belt 44 falls within the temperature region defined by the fixing strength guaranteed critical border line a and the offset generation critical border line b in the fixing strength/high temperature offset characteristic diagram shown in FIG. 1. In this case, it is preferable that the length of the circumference of the pressurizing belt 55 be set such that the surface temperature of the belt 55 is in a vicinity of the center line between the fixing strength guaranteed critical border line a and the offset generation critical border line b.

Even in the case where there occurs large variations in the surface temperature T1 of the fixing roller 51 and the surface temperature T2 of the pressurizing belt 55, the surface temperature T1 of the fixing roller 51 and the surface temperature T2 of the pressurizing belt 55 can be controlled to always fall within the non-offset region.

In the present embodiment, by providing the support roller 54 on the upstream side of the pressurizing roller 3 in the transport direction of the sheet P, the belt 55 can be stretched along the transport direction of the sheet P. As a result, a heat releasing region is formed along the transport direction of the sheet P on the upstream side in the transport direction of the sheet P. For this reason, the pressurizing belt 55 functions as the transport member of the sheet (recording material transport means) and the pre-heating member for heating the sheet P by releasing heat to the sheet P and absorbing heat of the sheet P.

In the structure of the described preferred embodiment, in order that the width Wa of the contact portion is selected to be 10 mm, and the width Wb of the pre-heating region (sheet transport region) is selected to be 75 mm, the extension force of the pressurizing belt 55 can be adjusted by the pressurizing roller 53 and the support roller 54.

The pressurizing belt 55 is made of resins which offer high heat releasing and cooling effect with small heat capacity, such as polyimide, nickel, etc., or heat-resisting material such as metals, etc. The pressurizing belt 55 may be made of only the heat-resisting material; however, to increase the offset generation critical temperature, the surface in contact with the fixing roller 51 of the heat-resisting layer 55*a*, i.e., the peripheral surface of the pressurizing belt 55 may be coated with a material which shows high releasing properties with respect to the toner to form a laminated structure wherein the coating layer 55*b* which shows excellent release properties such as silicone rubber (LIV), PFA (perfluoroalkyl vinyl ether-polytetrafluoroethylene copolymer resin), etc., is laminated.

In the present embodiment, for the pressurizing belt 55, a thin film belt having a small heat capacity of a laminated structure wherein a coating layer 55*b* made of silicone rubber having a thickness of 0.05 mm is formed on a heat-resisting layer 55*a* made of polyimide having a circumference length of 80 mm and a thickness of 0.05 mm is used. Therefore, the pressurizing belt 55 shows excellent effects of releasing heat from the surface and suppressing temperature rise. Additionally, in the case where the pressurizing belt 55 has the above structure, an offset generation critical temperature can be improved.

The pressurizing roller 53 pressurizes the fixing roller 51 via the pressurizing belt 55, and in the contact portion, the pressurizing roller 53 is heated by the fixing roller 51 via the pressurizing belt 55 in the contact portion. For this reason, the pressurizing roller 53 is formed by a material of low thermal conductivity, preferably by a heat-resistant material such as a foam resistant material. When the pressurizing roller 53 made of a heat insulating material such as a foam elastic member, etc., as the heat received by the fixing roller 51 is likely to laminate the pressurizing roller 53 via the pressurizing belt 55, a rise in temperature of the pressurizing belt 55 at the contact portion can be suppressed. Therefore, by forming the pressurizing roller 53 from a heat insulating material, with a rise in temperature of the fixing roller 51, it is less likely that the surface temperature T2 of the pressurizing belt 55 in the contact portion following the surface temperature T1 of the fixing roller 51 vary. As a result, by controlling an application of heat to the fixing roller 51 according to the surface temperature T2 of the pressurizing belt 55, the surface temperature T1 of the fixing roller 51 and the surface temperature T2 of the pressurizing belt 5 can be adjusted within the non-offset region.

Especially, in the case of adopting the pressurizing roller 53, as foams exist inside, the roller material contain air of small thermal conductivity. Therefore, by adopting the elastic member having foams, heat insulating properties can be improved compared with the case of adopting the elastic material without foams.

In the present embodiment, a roller having a small thermal conductivity made of silicone sponge having a diameter $\phi$ of 30 mm is adopted for the pressurizing roller 53.

On the other hand, among rollers which stretch the pressurizing belt 55, the support roller 54 which does not press the fixing roller 51 is made of a material of high thermal conductivity and heat capacity, preferably, for example, a metal material such as SUS, aluminum, etc., particularly a metal material of high density.

In the present embodiment, for the support roller 54, a solid roller made of aluminum having a diameter of 30 mm is adopted. As described, by adopting the support roller provided outside the contact portion made of a material of a large thermal capacity which shows an excellent thermal conductivity such as a metal material, etc., in the case of successively fixing the toner T onto the sheet P, the heat energy directly transmitted from the fixing roller 51 to the pressurizing roller can be absorbed during the stand-by time for the transport of the sheet P and can release in the stand-by time of the fixing operation. As a result, a rise in temperature in the contact portion of the pressurizing belt 55 can be reduced. By forming the support roller 54 having a solid structure adopting the material, a still improved heat capacity can be achieved.

The metal surface of the support roller 54 can be maintained as it is; however, it may be coated with a material of high coefficient of friction such as fluorocarbon rubber, etc., so that the pressurizing belt 55 can be rotated under stable conditions.

Namely, the pressurizing roller 53 is interlocked with the fixing roller 51 by means of a gear. Specifically, when the fixing roller 51 rotates in a direction of an arrow A by the drive means (to be described later), the pressurizing roller 53, the support roller 54 and the pressurizing belt 55 are driven so as to rotate in a direction of an arrow B.

In a vicinity of the contact portion on the inner circumference (back surface) of the pressurizing belt 55, a thermistor 56 serving as the pressurizing belt temperature detection means (second temperature detection means) is mounted, and the surface temperature T2 of the pressurizing belt 55 is detected.

The fixing roller 51 is provided with the heater lamp 51*c* in its inside as heat source (heater means) and with respect to the rotating direction of the fixing roller 51, in a vicinity of the upstream side of the contact portion (fixing nip portion), the fixing roller temperature detection means (first temperature detection means) for detecting the surface temperature T1 of the fixing roller 51 is provided as the thermistor 57.

The fixing roller 51 is structured so as to include a core member 51*a* of a cylindrical hollow shape made of aluminum, USU, etc., and a coating layer 51*b* made of a composite material, etc., which shows excellent heat-resisting properties and releasing properties for contacting the surface of the core member 51*a*.

For the composite resin material which constitutes the coating layer 51*b*, for example, a polymer material such as silicone rubber, fluorocarbon rubber, etc., fluorocarbon resin such as PFA, PTEF (polytetrafluoroethylene), etc., or a mixture of these fluorocarbon resin and fluorocarbon rubber may be suitably adopted. As they offer excellent heat-resisting properties and releasing properties without releasing the heat from the coating layer 51*b* heated by the heater lamp 51*c* to the inside of the fixing roller 51. Beneficial characteristics of these materials lie also in that a predetermined nip width can be formed by being deformed appropriately and flexibly by the pressurizing roller 53 via the pressurizing belt 55.

In the present embodiment, it is structured such that aluminum cylindrical roller having a diameter of 30 mm and a thickness of 1.5 mm is used as a core material 51*a*, a coated layer 51*b* made of silicone rubber having a thickness of 1 mm is molded. Additionally, the rated output of the heater lamp 51*c* provided inside the fixing roller 51 is 800 W.

An operation of the fixing device 50 having the described arrangement will be explained in reference to FIGS. 1 and 2, and FIGS. 4–6.

In the fixing device 50, during the warm-up time, the surface of the fixing roller 51 is heated by the heater lamp 51*c*. The surface temperature T1 of the fixing roller 51 is detected by the thermistor 57, and the conductivity to the heater lamp 51*c* is controlled by the control circuit 17 (heat control means) based on the detection signal so as to heat the surface to a predetermined temperature within the region (non-offset region) defined by the fixing strength guaranteed critical border line a and the offset generation critical border line b in the fixing strength/high temperature offset characteristic diagram shown in FIG. 1. As described, in the present embodiment, the control circuit 17 functions also as the conductivity control means (heat application control means) for controlling the conduct to the heater lamp 51*c*, i.e., an application of heat by the fixing roller 51. In the present embodiment, the fixing roller 51 is heated to 187° C., and the pressurizing belt 55 is heated to 50° C.

In the described fixing device 50, it is preferable that both the fixing roller 51 and the pressurizing mechanism 52 stop rotating during the warm-up time.

Therefore, the fixing roller 51 is controlled by the control circuit 17 such that upon detecting that the surface of the fixing roller 51 is heated to a predetermined temperature, the fixing roller 51 stops rotating. Namely, in the present embodiment, the control circuit 17 functions as the rotation start control means for starting the rotations of the fixing roller 51 and the pressurizing mechanism 52.

Figure 5:
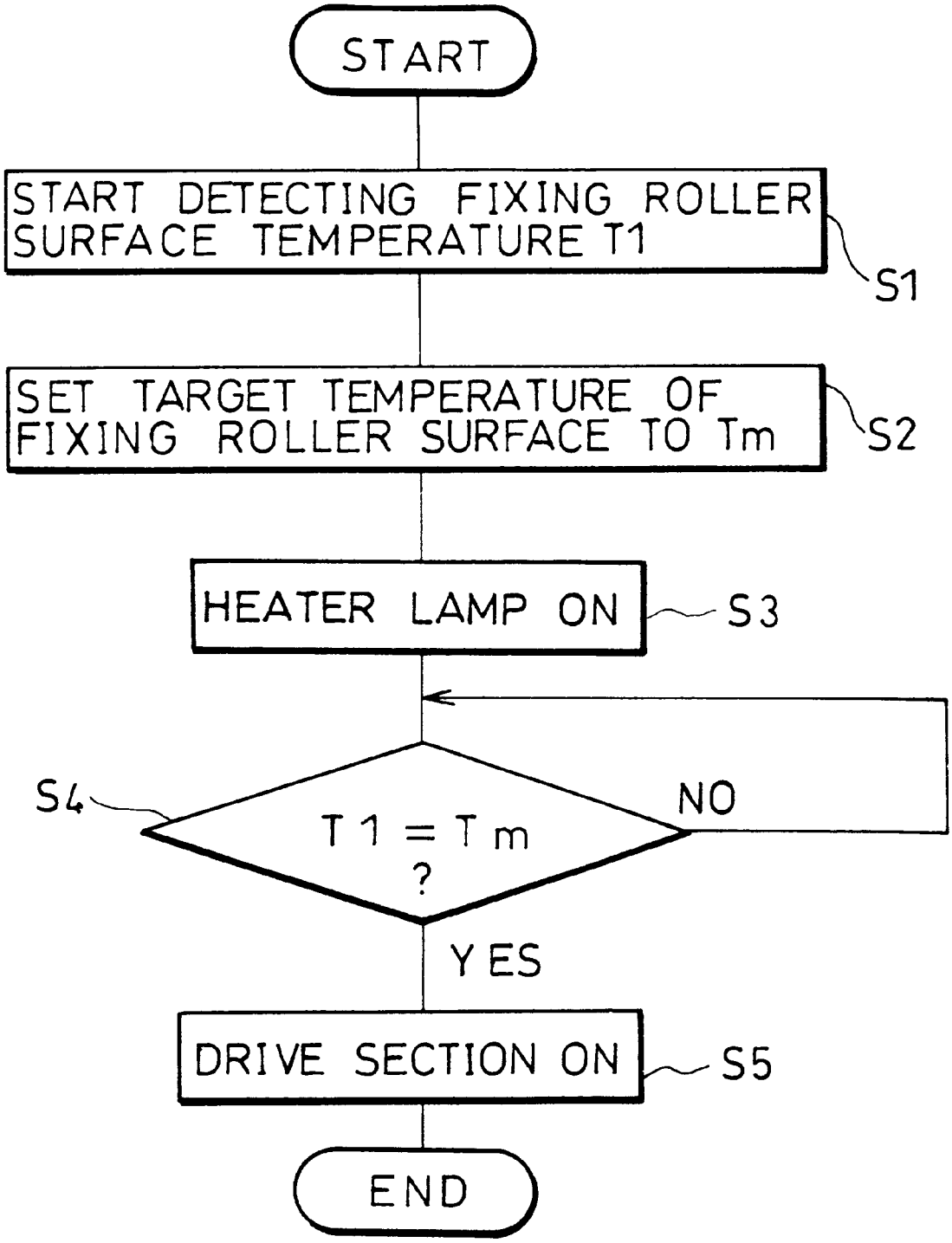
FIG. 5 is a flowchart showing processes of controlling rotations of the fixing roller during the warm-up time.

The above control of the fixing roller 51 during the warp-up time will be explained in reference to the flowcharts of FIG. 1 and FIG. 5.

First, when the power of the laser printer is turned ON, and the fixing device, etc., starts warming-up, and the control circuit starts detecting the surface temperature T1 of the fixing roller 51 by the thermistor 57 (S1), and the target temperature on the surface of the fixing roller 51 is set to Tm (S2) to set the heater lamp 51*c* ON (S3).

Then, it is determined if the surface temperature T1 of the fixing roller 51 is heated to the target temperature Tm (S4). Then, if the surface temperature T1 of the fixing roller 51 is heated to the target temperature Tm, it is determined that the surface temperature ti of the fixing roller 51 in the fixing nip portion is raised to a temperature at which a fixing operation can be carried out (the fixing roller 51 has been warmed up). Then, the drive section (drive means) for driving the fixing roller 51 is set ON (S5), and drives the fixing roller 51 so as to rotate. Here, as the pressurizing roller 53 which constitutes the pressurizing mechanism 52 is linked with the fixing roller 51 and the gear, when the fixing roller 51 rotates in a direction of an arrow A by driving the drive section, the pressurizing roller 53, the support roller 54 and the pressurizing belt 55 rotate in the direction of an arrow B.

As described, in the fixing device 50, during the warp-up time for heating the surface temperature T1 of the fixing roller 51 to a predetermined temperature, if both the fixing roller 51 and the pressurizing mechanism 52 stop rotating, even if the surface of the fixing roller 51 is heated to a predetermined temperature, an amount of heat transferred from the fixing roller 51 to the pressurizing belt 55 is small, and the heat energy to be taken by the contact with the pressurizing belt 55 can be reduced, thereby reducing the warm-up time.

When the fixing device 50 has been warmed up to be ready for a fixing operation, the fixing roller 51 rotates in a direction of an arrow A at a peripheral speed of 120 mm/seconds, and the sheet P having thereon an unfixed toner T is transported to the contact portion between the fixing roller 51 and the pressurizing belt 55 from the direction of an arrow C.

Here, the surface temperature T1 of the fixing roller 51 and the surface temperature T2 of the pressurizing belt 55 are detected by the thermistor 57, 56. Here, based on the detection signal, the control circuit 17 controls the conduct to the heater lamp 51*c* in such a manner that the surface temperature T1 of the fixing roller 51 and the surface temperature T2 of the pressurizing belt 55 at the contact portion (fixing nip portion) between the fixing roller 51 and the pressuring belt fall within the region (non-offset region) defined by the fixing strength guaranteed critical line a and the offset generation critical border line b.

Figure 6:
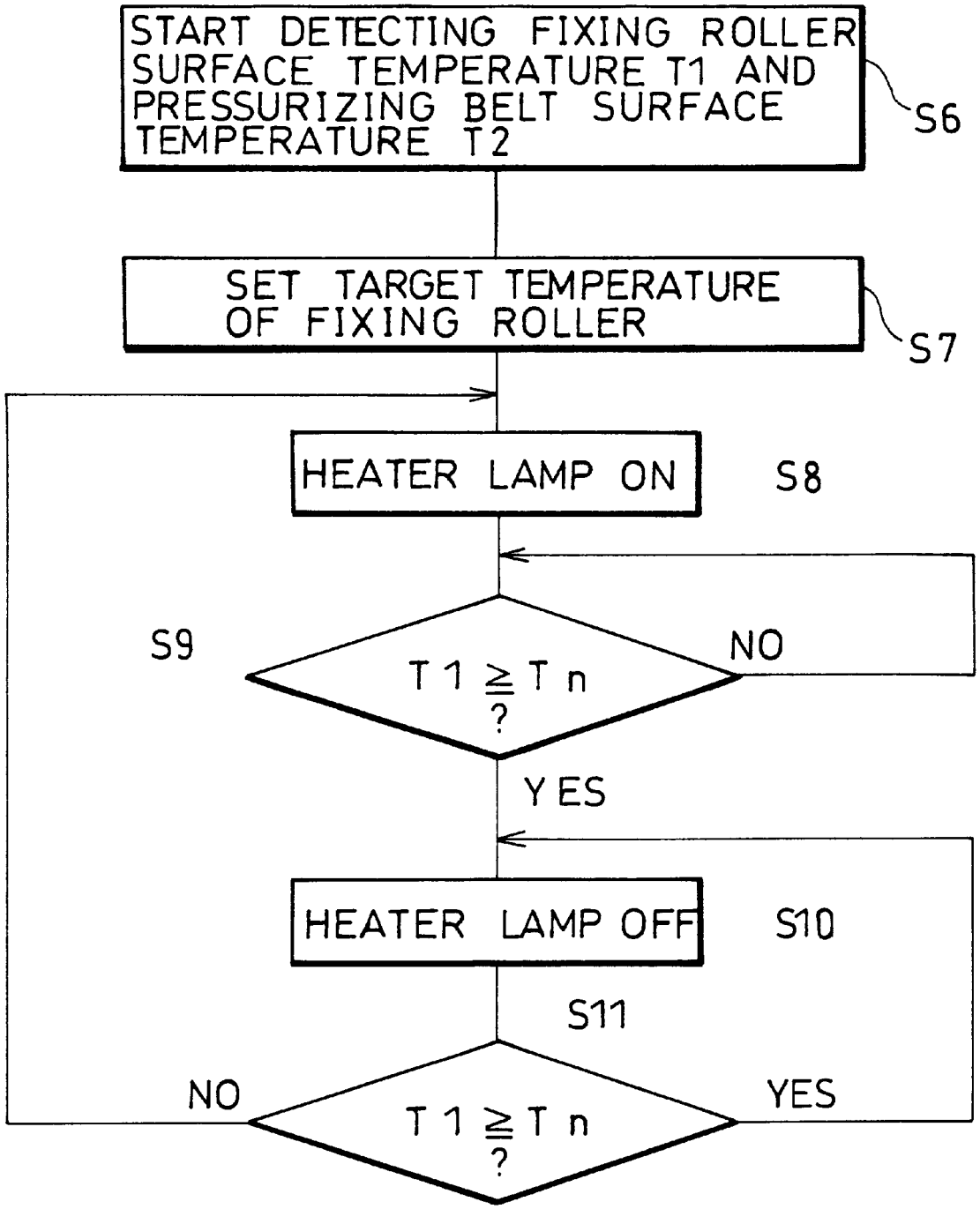
FIG. 6 is a flowchart showing processes of controlling the surface temperature of the fixing roller and the surface temperature of the pressurizing belt in the fixing process.

Here, the control of the surface temperature T1 of the fixing roller 51 and the surface temperature T2 of the pressurizing belt 55 for the fixing operation will be explained in reference to the flowcharts of FIGS. 1, 2 and 6.

When the fixing device 50 has been warmed up to be ready for the fixing operation, the control circuit 17 starts detecting the surface temperature T1 of the fixing roller 51 and the surface temperature T2 of the pressurizing belt 55 by means of thermistors 57 and 56 (S6), and sets the target temperature on the surface of the fixing roller 51 to TN (S7), and sets the heater lamp 51*c* ON (S8).

Here, the target temperature Tn of the surface of the fixing roller 51 can be computed from the function of the surface temperature T1 of the pressurizing belt 55 (Tn=f(T2)), which is set such that the surface temperature T1 of the fixing roller 51 and the surface temperature T2 of the pressurizing belt 55 fall in the region (non-offset region) defined by the fixing strength guaranteed critical border line a and the offset generation critical border line b in the fixing strength/high temperature offset characteristic diagram shown in FIG. 1, preferably to the temperature on the center line between the fixing strength guaranteed critical border line a and the offset generation critical border line b.

Figure 2:
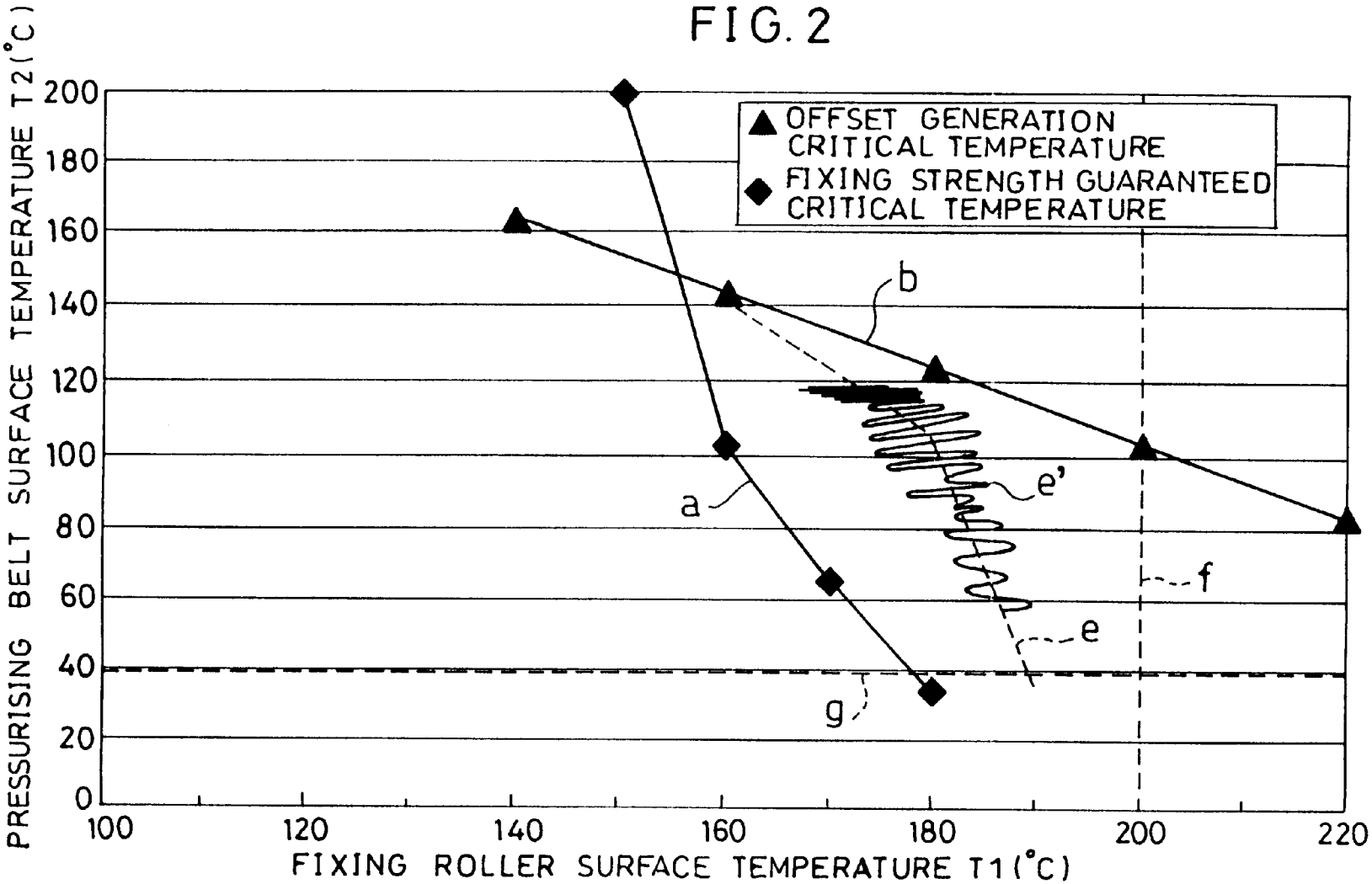
FIG. 2 is a temperature control characteristics diagram of a fixing roller surface temperature and a pressurizing belt surface temperature of a fixing device in accordance with one embodiment of the present invention.

Here, the temperature control characteristics diagram of the surface temperature T1 of the fixing roller 51 and the temperature control characteristic diagram of the surface temperature T2 of the pressurizing belt 55 (surface temperature T1 of the fixing roller 51 and the surface temperature T2 of the pressurizing belt 55) are as shown in FIG. 2.

Here, it is preferable that the target temperature Tn on the surface of the fixing roller 51 be set to not more than 220° C. to ensure the thermal durability of the fixing roller 51. For the product level which offers an improved safety level, as shown by the dotted line (border line) shown in FIG. 2, the temperature is set to not more than 200° C. Here, if the surface temperature T2 of the pressurizing belt 55 is too low, the non-offset region can be made narrower. Therefore, the surface temperature T2 of the pressurizing belt 55 is preferably set to not less than 40° C.

In the present embodiment, Tn is obtained by the following formula:

$$Tn=f(T2)=(\text{fixing strength guaranteed critical temperature}+\text{offset generation critical temperature})/2.$$

Next, it is determined if the surface temperature T1 of the fixing roller 51 is not less than the target temperature Tn (S9). Here, if the surface temperature T1 of the fixing roller 51 is raised to be not less than the target temperature Tn, the heater lamp 51*c* is set OFF (S10).

Thereafter, it is determined again if the surface temperature T1 of the fixing roller 51 is not more than the target temperature Tn (S11). If the surface temperature T1 of the fixing roller 51 is detected to be below the target temperature Tn, a sequence goes to S8 to set ON the heater lamp 51*c*. Namely, in the present embodiment, the heater lamp 51*c* provided in the fixing roller 51 is controlled based on the surface temperature T2 of the pressurizing belt 55 and the surface temperature T1 of the fixing roller 51 as detected by the thermistors 56 and 57 so as to maintain the surface temperature T1 of the fixing roller 51 and the surface temperature T2 of the pressurizing belt 55 within the non-offset region.

Under the described control, as shown by the temperature ripple e' shown in FIG. 2, the surface temperature T1 of the fixing roller 51 and the surface temperature T2 of the pressurizing belt 55 can be controlled in a vicinity of the target temperature shown by the dotted line e in FIG. 2.

The fixing device 50 in accordance with the present embodiment is evaluated with respect to the fixing strength and an occurrence of the offset are evaluated, and the results are shown in Table 1. For comparison, the conventional fixing device of the internal heating system is evaluated with respect to the fixing strength and an occurrence of the offset are evaluated, and the results are shown in Table 2. The evaluation on the fixing strength is made by the following bending test.

Bending Test

① A recording/fixing operation of a solid portion of a recording material (sheet P) of 5 cm×5 cm is carried out.

② Thereafter, the central portion of the recording portion of the recording material is slightly bent inside, and by rolling the cylindrical weight of 1 kg on the recording material, the central portion of the recording portion is bent.

③ Thereafter, the fold is opened, and the fold is rubbed with a gauze to wipe off the dropped toner.

④ The state of the dropped toner (fixing properties) is evaluated by comparing it with samples prepared beforehand with eyes. The samples are prepared for the following five levels depending on the state of the dropped toner.

Level 1: A substantial amount of toner is dropped;

Level 2: A large amount of toner is dropped;

Level 3: It is obvious that there exists dropped toner;

Level 4: A small amount of toner is dropped; and

Level 5: A dropped toner is hardly observed.

In the present invention, for the result of the bending test, the level 5 is considered to be desirable (shown by o in Tables), and it is determined that a sufficient fixing strength can be ensured.

TABLE 1

| PROCESS SPEED: 120 mm/seconds | | Without Oil Application | | | | | |
|---|---|---|---|---|---|---|---|
| FIXING ROLLER SURFACE TEMP. (° C.) | | 150 | 160 | 170 | 180 | 190 | 200 |
| PRESSURIZING BELT SURFACE TEMP. (° C.) | | 80 | | | | | |
| FIXING PROPERTIES | FIXING STRENGTH | ○ | ○ | ○ | ○ | ○ | ○ |
| | OCCURRENCE OF HIGH TEMPERATURE OFFSET | NO | NO | NO | NO | NO | NO |

TABLE 2

| PROCESS SPEED: 120 mm/seconds | | Without Oil Application | | | | | |
|---|---|---|---|---|---|---|---|
| FIXING ROLLER SURFACE TEMP. (° C.) | | 150 | 160 | 170 | 180 | 190 | 200 |
| PRESSURIZING BELT SURFACE TEMP. (° C.) | | 130 | 140 | 150 | 160 | 170 | 180 |
| FIXING PROPERTIES | FIXING STRENGTH | ○ | ○ | ○ | ○ | ○ | ○ |
| | OCCURRENCE OF HIGH TEMPERATURE OFFSET | NO | NO | YES (NO) | YES (NO) | YES (NO) | YES (NO) |

As shown in Table 1, the fixing device 50 is structured such that the surface temperature T2 of the pressurizing belt 5 does not follow the surface temperature T1 of the fixing roller 51, and thus the surface temperature T2 of the pressurizing belt 55 can be maintained within the non-offset region, and an occurrence of the offset can be prevented without an application of offset-prevention-use oil, and a sufficient fixing strength can be obtained.

On the other hand, in the case of adopting the fixing device of the conventional internal heating system, the surface temperature of the fixing roller (fixing means surface temperature T1) is lowered, and the surface temperature of the pressurizing roller (pressurizing means surface temperature T2) and the surface temperature of the fixing roller (fixing means surface temperature T1) are maintained within the non-offset region, an occurrence of the offset can be prevented, and a sufficient fixing strength can be ensured. However, as can be seen from the results shown in Table 2, in the fixing device adopting the conventional heating system, in order to adopt the fixing method of the present invention, the permissible range W1 of the temperature of the fixing roller which can be set within the non-offset region is around 10 deg, which is not suited for practical applications.

In contrast, when adopting the fixing device 50 of the present embodiment, for example, by setting the surface temperature T1 of the pressurizing belt 55 as shown in Table 1 to 80° C., the permissible temperature width W2 which can be set within the non-offset region is around 55 deg as shown in FIG. 1, and the temperature permissible range of not less than 30 deg can be ensured under stably conditions. Therefore, it can be seen that the fixing device 50 is suited for the fixing method of the present invention.

As described, according to the present embodiment, to the toner T electro-statically adhering to the sheet P being conveyed to the contact portion (fixing nip portion), desirable heat and pressure from the fixing roller 51 and the pressurizing mechanism 52 can be applied. As a result, the toner T electro-statically adhering to the sheet P is melted under an applied heat, and can be fixed onto the sheet P without generating offset without an application of oil.

As described, by carrying out the described fixing operation using the fixing device 50 in accordance with the present embodiment, an occurrence of the offset can be prevented, and a fixing inferior of the toner T, etc., can be reduced. As a result, a quality image can be formed. Additionally, by adopting the fixing device and the fixing method, for example, during the warm-up time, an excessive releasing of heat from the fixing roller 51 to the pressurizing mechanism 52 can be prevented, and a warm-up time can be reduced to be suited especially for high speed printer.

The described preferred embodiment is arranged such that the fixing roller 51 is pressurized only by means of the pressurizing roller 42. However, for example, it may be arranged such that the fixing roller 51 is pressurized by a plurality of rollers which increase the fixing nip section.

In the present embodiment, other than the pressurizing roller 52, only the support roller 53 stretches the pressurizing belt 55. However, in order to adjust the length of the pressurizing belt 55 or the extension force, or to control the temperature of the pressurizing belt 55, it may be arranged such that a plurality of rollers which do not suppress the fixing roller may be provided.

In the present embodiment, the fixing means is composed of the fixing roller, and the pressurizing means is constituted by the pressurizing mechanism. However, it may be arranged such that the pressurizing means is composed of a roller made of material of a small thermal conductivity such as heat insulating material, and as a sufficient heat releasing area, and a permissible temperature range of the fixing roller of not less than 30 deg can be obtained in the non-offset region.

As described, the fixing method for fixing an unfixed toner image formed on a recording material by transporting a recording material having formed thereon an unfixed toner image to a contact portion between fixing means and pressurizing means for pressurizing a surface of the fixing means preferably includes the steps of:

(i) obtaining beforehand a non-offset region defined by a critical border line obtained from a function of a fixing means surface temperature and a pressurizing means surface temperature in which a sufficient fixing strength for fixing toner onto the recording material can be ensured without generating a high temperature offset; and (ii) controlling the fixing means surface temperature and the pressurizing means surface temperature at the contact portion while the recording material is being transported therethrough to fall within the non-offset region.

It is more preferable that the critical border line includes at least a first critical border line indicating temperatures of an interface between the recording material and the toner which offer sufficient fixing strength for fixing the toner onto the recording material, and a second critical border line indicating temperatures of an interface between the fixing means and the toner at which a high temperature offset does not occur.

It is still more preferable that the critical border line further includes a third critical border line indicting temperatures at which thermal durability of the fixing means can be guaranteed.

It is still more preferable that the fixing means surface temperature and the pressurizing means surface temperature at the contact portion at a time the recording material is being transported therethrough are controlled to be around a center line between the first critical border line and the second critical border line.

It is also preferable that the described step (ii) includes the steps of:

measuring the fixing means surface temperature and the pressurizing means surface temperature; and controlling heat application to the fixing means based on the fixing means surface temperature and the pressurizing means surface temperature.

It is also preferable that the described method further include the step of controlling the fixing means and the pressurizing means so as to start rotating when a surface temperature of the fixing means is detected to be ready for a fixing operation.

As described, the fixing device of the present invention is characterized by including:

fixing means;

pressurizing means for pressurizing a surface of the fixing means;

heating means for heating the fixing means;

first temperature detection means for detecting a surface temperature of the fixing means in a vicinity of the contact portion, the first temperature detection means being provided in a vicinity of the contact portion of the fixing means;

second temperature detection means for detecting a surface temperature of the pressurizing means in a vicinity of the contact portion, the second detection means being provided in a vicinity of the contact portion of the pressurizing means; and heat application control means for controlling the heating means based on results of detection by the first temperature detection means and the second temperature detection means, wherein the heat application control means controls the fixing means surface temperature and the pressurizing means surface temperature at the contact portion while the recording material is being transported therethrough within a non-offset region in which a sufficient fixing strength for fixing toner onto the recording material can be ensured without generating a high temperature offset, the non-offset region being defined by a critical border line obtained from a function of a fixing means surface temperature and a pressurizing means surface temperature.

The described arrangement may further include rotation start control means for controlling the fixing means and the pressurizing means so as to start rotating when the surface temperature of the fixing means detected by the first temperature detection means is reached to a temperature at which a fixing operation can be performed.

It may be also arranged such that the pressurizing means includes at least one pressurizing roller made of an insulating material, the pressurizing roller being parallely provided with the fixing means so as to pressurize a surface of the fixing means and at least one pressurizing belt support roller being provided outside of the contact portion, and a pressurizing belt being stretched to the outside of the contact portion by the pressurizing roller and the pressurizing belt support roller.

In the above arrangement, it is preferable that the heat-insulating material be a foam elastic member.

It is also preferable that the pressurizing belt is stretched in the transport direction of the recording material to an upstream side of the contact portion in the transport direction of the recording material.

It is also preferable that the fixing device of the described structure further includes recording material attraction means for attracting the recording material onto the surface of the pressurizing belt, wherein the pressurizing belt functions also as recording material transport means for transporting the recording material having formed thereon an unfixed toner image to the contact portion while being attracted onto the surface of the pressurizing belt.

For the pressurizing belt, it is preferable to adopt a pressurizing belt of a thin film of a laminated structure wherein a release material is laminated onto the heat-resisting material.

Second Embodiment

Figure 7:
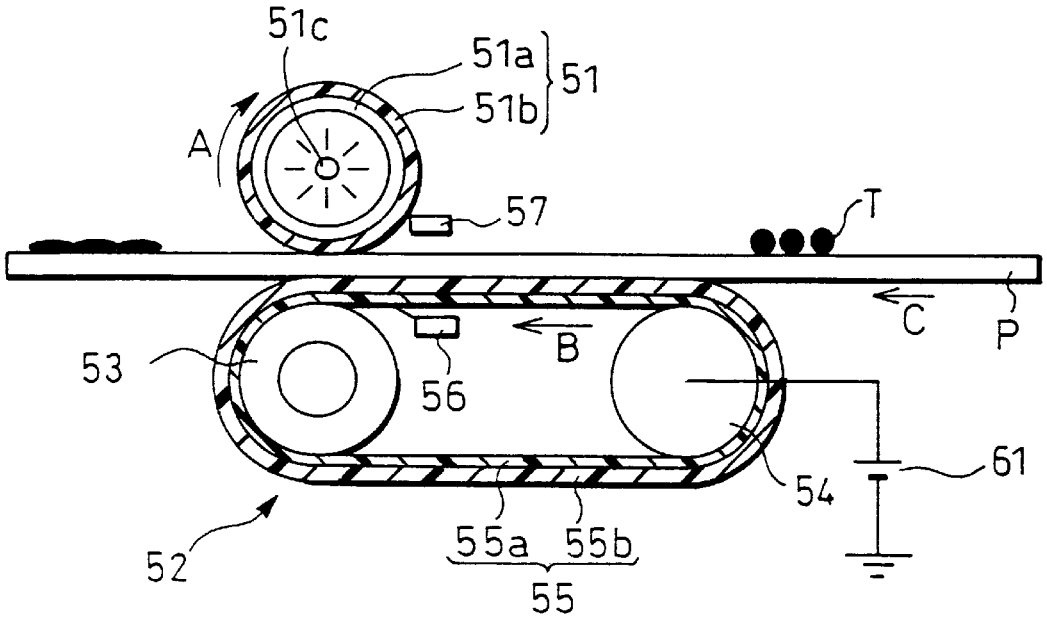
FIG. 7 is a diagram schematically showing the structure of the fixing device in accordance with another embodiment of the present invention.

The following descriptions will explain another embodiment of the present invention in reference to FIG. 7. For convenience in explanations, members having the same function as the aforementioned embodiments will be designated by the same reference numerals, and the explanations thereof shall be omitted here.

As shown in FIG. 7, the fixing device in accordance with the present embodiment has the same structure as the fixing device 50 of the first embodiment except for that a power source 61 (recording material attraction means) for applying a voltage to the support roller 54 is further provided.

The sheet P having the toner T adhered thereto is negatively charged, and by applying a positive voltage to the support roller 54 (500 V in the present embodiment), the sheet P having the toner T which has not yet been affixed thereto can be electrically attracted to the surface of the pressurizing belt 55. According to the described arrangement, comparing with the case without an application of voltage to the support roller 54, the sheet P can be conveyed to the fixing nip section while maintaining a more tight contact with the pressurizing belt.

Therefore, according to the described arrangement, the heat stored onto the pressurizing belt 55 can be absorbed by the sheet P efficiently, and a still improved effect of suppressing a temperature rise in the contact portion with the pressurizing belt 55 can be achieved. Moreover, according to the described method, compared with the case without an application of voltage, the heat releasing region of the pressurizing belt 55 can be reduced, and a compact size of the device can be achieved. Furthermore, by pre-heating the sheet P, the heating temperature by the fixing roller 51 can be set low within the range of the non-offset region, and a reduction in the warm-up time can be achieved.

As long as the sheet P can be conveyed while being attracted to the pressurizing belt 55, the method of attracting the sheet P is not particularly limited.

As described, the fixing device of the present invention having the basic structure of the first embodiment may be arranged so as to further include the recording material attraction means for attracting the recording material onto the surface of the pressurizing belt, wherein the pressurizing belt functions also as recording material transport means for transporting the recording material having formed thereon an unfixed toner image to the contact portion while being attracted onto the surface of the pressurizing belt.

Third Embodiment

Figure 8:
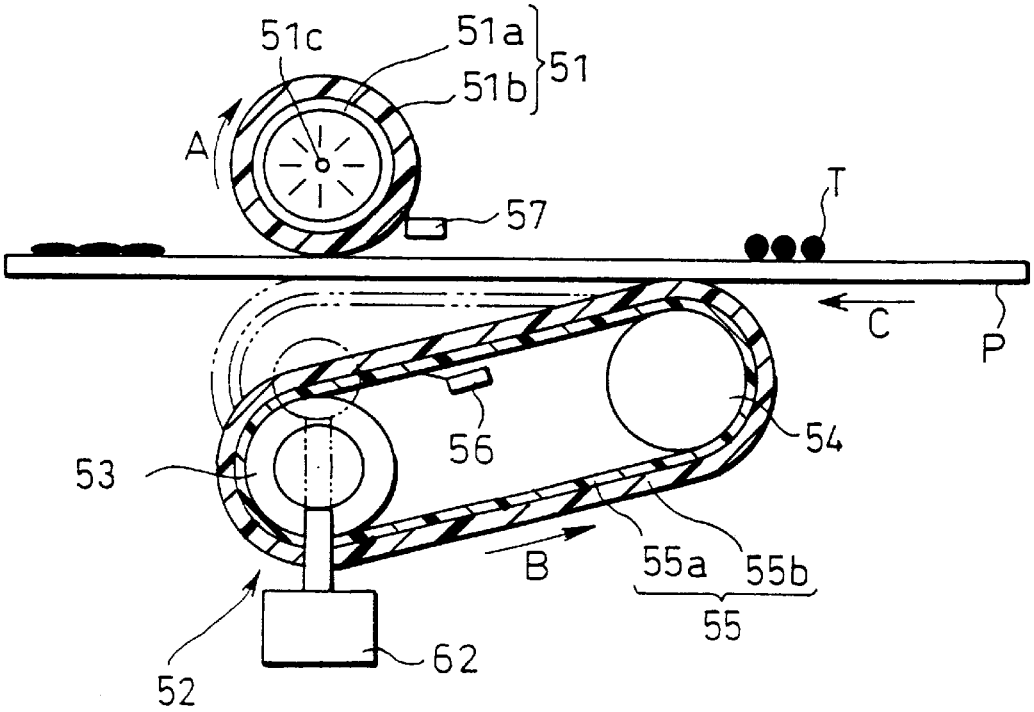
FIG. 8 is a diagram schematically showing the structure of a fixing device in accordance with still another embodiment of the present invention.

The following descriptions will explain another embodiment of the present invention in reference to FIG. 8. For convenience in explanations, the members having the same functions as the aforementioned embodiments will be designated by the same reference numerals, and thus the descriptions thereof shall be omitted here.

As shown in FIG. 8, the fixing device in accordance with the present embodiment is arranged so as to link an electromagnetic solenoid 62 (moving means) to the pressurizing roller 53 based on the structure of the fixing device 50 of the first embodiment.

According to the structure of the present embodiment, during the period where the transportation of the sheet P is not carried out, such as warm-up time, and a stand-by time for transporting the sheet P for successively fixing the toner t to the sheet P, the pressurizing mechanism 52 is separated from the fixing roller 51.

Namely, in the present embodiment, a sheet detection actuator 15 (recording material detection means) is tilted, and a sheet detection sensor 16 (recording material detection means) is set ON. Upon detecting that the sheet P is transported to the side of the image forming device 20, based on the detection signal, the control circuit 17 controls an electromagnetic solenoid 62 so as to pressurize the pressurizing belt 55 onto the fixing roller 51 via the pressurizing roller 53. On the other hand, after the sheet P has been transported, the pressurizing mechanism 52 is separated from the fixing roller 51. Namely, in the present embodiment, the control circuit 17 functions also as the separate/control means.

Therefore, according to the described arrangement, by reducing the period in which the fixing roller 51 and the pressurizing belt 55 directly contact with each other without having the sheet P in-between, and the thermal conductivity from the fixing roller 51 to the pressurizing belt 55 in the fixing nip section can be reduced. Therefore, the described arrangement permits a temperature rise of the pressurizing belt 55 be suppressed, and the pressurizing mechanism 52 pressurizes the fixing roller 51 when necessary, thereby preventing the fixing roller 51 form being deformed permanently by an applied pressure.

By arranging such that the pressurizing mechanism 52 is movably supported to be in contact with and separated from the fixing roller 51, the surface temperature T2 of the pressurizing belt 55 can be controlled by the contact and separation of the pressurizing mechanism 52.

According to the structure of the first embodiment, by the heater lamp 51*c* provided inside the fixing roller 51 so as to apply heat based on the surface temperature T of the pressurizing belt 55, the surface temperature T1 of the fixing roller 51 and the surface temperature T2 of the pressurizing belt 55 can be controlled within the non-offset region. In the present embodiment, in addition to the described structure of the first embodiment, by controlling the pressurizing belt 55 so as to come in contact and separate based on the surface temperature T2 of the pressurizing belt 55, the surface temperature T2 of the pressurizing belt 55 can be controlled in an easier manner.

As described, in the case of separating the pressurizing belt 55 based on only the transport data of the sheet P (i.e., the separation state of the pressurizing belt 55 is switched between when transporting the sheet P and when transporting the stand-by state), since a rise in temperature of the pressurizing belt 55 can be suppressed, the surface temperature T1 of the fixing roller 51 and the surface temperature T2 of the pressurizing belt 55 can be controlled with ease.

As described, the fixing method having the basic arrangement of the first embodiment may further include the step of separating the pressurizing means from the fixing means when the recording material is not being transported through the contact portion.

As described, the fixing device of the present invention having the basic structure of the first embodiment may be arranged so as to further include moving means for moving the pressurizing means to be in contact with and separated from the fixing means.

It may be also arranged such that the fixing device further includes:

recording material detection means for detecting the recording material, the recording material detection means being provided in an upstream side in a transport direction of the recording material, wherein the pressurizing means is movably supported by the fixing means to be in contact with and separated from the fixing means such that upon detecting the recording material by the recording material detection means, the fixing means can move to be in contact with the fixing means.

In the described arrangement, the pressurizing means may be supported so as to be movable to be in contact with and separated from the fixing means, the fixing means being fixed.

Fourth Embodiment

Figure 9:
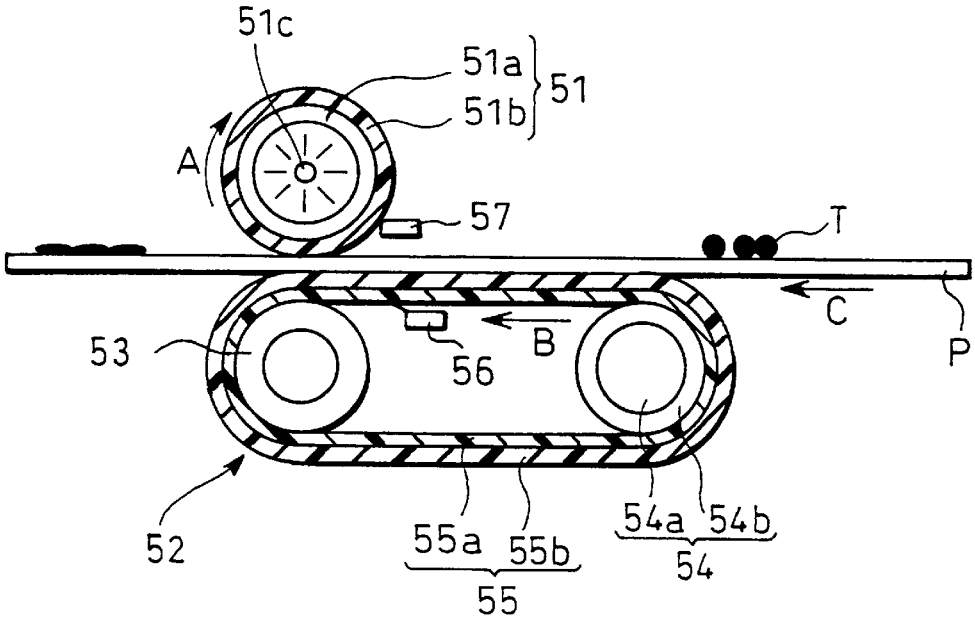
FIG. 9 is a diagram schematically showing the structure of a fixing device in accordance with still another embodiment of the present invention.
Figure 10:
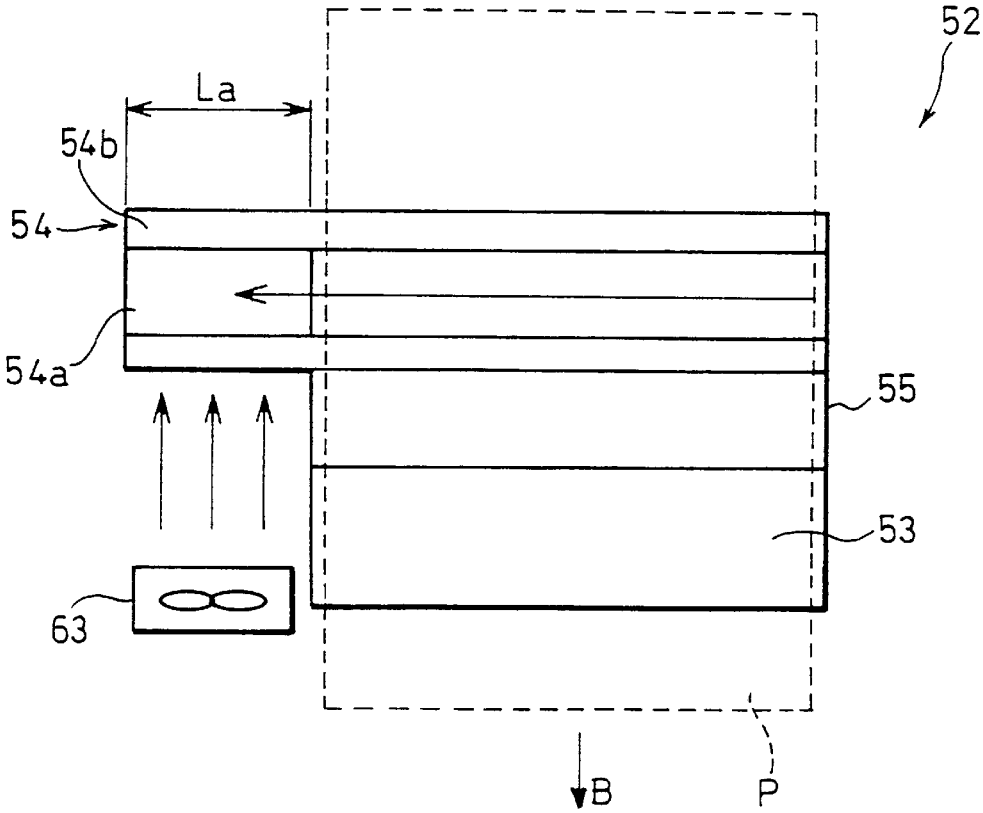
FIG. 10 is an explanatory view showing the structure of a heat pipe provided in the fixing device shown in FIG. 9.
Figure 11:
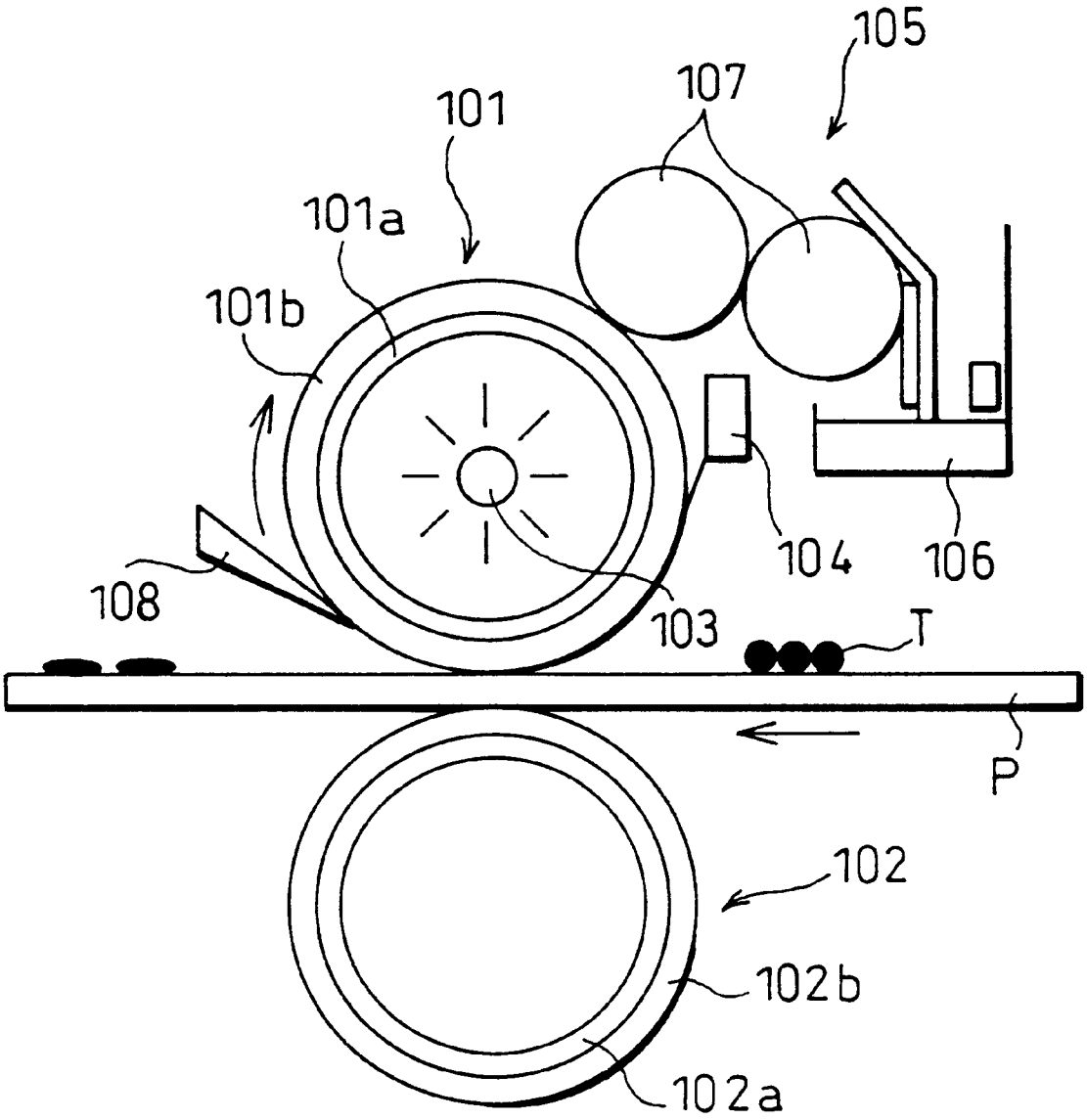
FIG. 11 PRIOR ART
FIG. 11 is a diagram schematically showing the structure of a structure of a conventional fixing device.

The following descriptions will explain another embodiment of the present invention in reference to FIG. 9 and FIG. 10. For convenience in explanations, members having the same function as those adopted in the first embodiment will be designated by the same reference numerals, and thus the descriptions thereof shall be omitted here.

As shown in FIG. 9 and FIG. 10, the fixing device of the present embodiment has the structure of the fixing device 50 adopted in the first embodiment except for the following. In replace of the solid roller made of aluminum, a heat pipe composed of a hollow roller 54 in which a circulating solution 54*a* is sealed inside is adopted for the support roller 54. The fixing device of the present invention is structured such that heat stored on the pressurizing belt 55 is released to the outside section via the heat pipe.

For the heat pipe, for example, a copper, aluminum or SUS pipe may be adopted. The pressure in the inside of the heat pipe is reduced, and a heat medium such as water, Freon, ammonia, etc., is placed therein a circulating solution 54*a*, and the heat transfer is performed by the movement of the steam of the circulating solution 54*a*, and leasing and receiving of latent heat of vaporization.

For the heat pipe, a heat releasing section La is provided so as to extend in an axial direction of the heat pipe, i.e., the widthwise direction of the pressurizing belt 55. Then, in a vicinity of the heat releasing section La, a cooling fan 63 is formed.

As a result, the heat transferred from the pressurizing belt 55 to the heat pipe is transferred to the heat releasing section La by the circulating solution 4*a*, and is cooled off in the heat releasing section La by the cooling fan 63. As a result, a heat pipe is cooled off entirely.

In the present embodiment, by the thermistor 56 formed on the back surface of the pressurizing belt 55, the surface temperature T2 of the pressurizing belt 55 is detected, and an air flow of the cooling fan 63 is controlled by the control circuit 17 such that the surface temperature T1 of the fixing roller 51 and the surface temperature T2 of the pressurizing belt 55 fall within the non-offset region.

It is effective to cool off the heat pipe during the time the fixing roller 51 and the pressurizing belt 55 directly contact with each other without having a sheet P therebetween such as a wait time for transporting the sheet P. In this case, the existence of the transport of the sheet P and the detection of the sheet P can be carried out by the sheet detection actuator 15 (recording material detection means) and the sheet detection sensor 16 (recording material detection means).

Therefore, according to the described arrangement, as in the structure of the third embodiment, the surface temperature T1 of the fixing roller 51 and the surface temperature T2 of the pressurizing belt 55 are controlled not only by controlling an application of heat by the heater lamp 51*c* provided inside the fixing roller 51 but also by cooling the pressurizing belt 55 by the heat pipe. As a result, the process of controlling the surface temperatures (the surface temperature T1 of the fixing roller 51 and the surface temperature T2 of the pressurizing belt 55) can be still simplified.

In the described preferred embodiments, explanations have been given through the case of applying the fixing device of the present invention to the monochrome laser printer; however, the present invention is not intended to limit this, and can be applied to color laser printers, color copying machines, etc.

As described, the fixing method of the present invention for fixing a toner onto a recording material by transporting the recording material having a toner image formed thereon to a contact portion between fixing means (for example, a fixing roller) and pressurizing means (for example, a pressurizing mechanism provided with a pressurizing belt) for pressurizing the surface of the fixing means may be arranged such that the surface temperature of the fixing means and the surface temperature of the pressurizing means at the contact portion at the time the recording material is passing therethrough are controlled to fall in the non-offset region defined by critical border lines obtained by the function of the surface temperature of the fixing means and the surface temperature of the pressurizing means, the critical border lines including at least (a) a first critical border line indicative of the interface temperature between the recording material and the toner which offers a sufficient strength of fixing the toner and the recording material, and (b) a second critical border line indicative of an interface temperature between the fixing means and the toner at which a high temperature offset does not occur.

According to the described arrangement, by controlling the surface temperature of the fixing means and the surface temperature of the pressurizing means within the non-offset region, an occurrence of an offset can be prevented without using the offset prevention use oil, and a fixing inferior of the toner can be reduced.

Namely, in the conventional method, the surface temperature of the pressurizing means, particularly, the relationship between the surface temperature of the fixing means and the surface temperature of the pressurizing means have not been considered. Therefore, in the conventional method, the pressurizing means is heated as the surface temperature of the fixing means is raised, and a fixing operation is performed in the region beyond the non-offset region. However, as a result of studies performed by the inventors, it becomes clear that there exits the critical border line obtained from the function of the surface temperature of the fixing means and the surface temperature of the pressurizing means. Therefore, by carrying out the temperature control based on the critical border line, a quality image can be formed without adopting the offset prevention-use oil.

In the described fixing method, it is preferable that the non-offset range is further defined by the third critical border line indicative of the temperature at which the thermal durability of the fixing device can be ensured.

According to the described arrangement, as the thermal deterioration of the fixing device can be also prevented, a fixing operation can be performed more desirably.

It is still more preferable that the surface temperature of the fixing device and the surface temperature of the pressurizing means be controlled in a vicinity of a center line between the first critical border line and the second critical border line while the recording material is being transported through the contact portion of the recording material.

According to the described arrangement, even in the case where there exists large variations in the surface temperature of the fixing means or the surface temperature of the pressurizing means or variations in environmental temperature, the surface temperature of the fixing means and the surface temperature of the pressurizing means can be controlled to fall within the non-offset region under stable conditions.

In each of the described arrangement, it is preferable that the heat insulating material be adopted for the pressurizing means, and that the fixing means is heated based on the surface temperature of the fixing means and the surface temperature of the pressurizing means as detected.

According to the described arrangement, by adopting the heat insulating material for the pressurizing means, the heat storage of the pressuring means can be suppressed. Therefore, a large variation in the surface temperature of the pressuring means as being affected by the surface temperature of the pressurizing means can be prevented. As a result, by controlling the heating of the fixing means according to the surface temperature of the fixing means and the surface temperature of the pressurizing means, the above surface temperatures can be controlled to fall within the non-offset region.

In the described arrangement, it is preferable that the pressurizing means be separated from the fixing means when necessary.

According to the described arrangement, the period in which the fixing means and the pressuring means are directly in contact with each other without having a recording material in-between such as the wait time for transporting the recording material, etc., can be reduced, and an amount of heat transferred from the fixing means to the pressurizing means in the contact portion can be reduced. Therefore, according to the described arrangement, a rise in temperature of the pressurizing means can be suppressed, and the pressurizing means pressurizes the fixing means only when necessary, and a permanent deformation of the fixing means under an applied pressure can be prevented.

Moreover, as the surface temperature of the pressurizing means can be controlled by moving the pressurizing means to be in contact with and separated from the pressurizing means, the surface temperature of the pressuring means can be controlled within the non-offset region.

It may be further arranged such that the fixing means and the pressurizing means start rotating when the surface temperature of the fixing means becomes ready for a fixing operation.

According to the described arrangement, as the fixing means and the pressurizing means stop rotating during the warm-up time until the surface of the fixing means is heated to temperatures at which a fixing operation can be performed. Therefore, when adopting the heat insulating material for the pressurizing means, even if the fixing means is heated during the warm-up time, compared with the arrangement wherein these means rotate, an amount of heat transferred from the fixing means to the pressuring means can be reduced, thereby reducing the warm-up time.

As described, the fixing device of the present invention which includes fixing means and the pressurizing means for pressurizing the surface of the fixing means for fixing a toner image onto a recording material by transporting the recording material having a toner image formed thereon to a contact portion between the fixing means and the pressurizing means may be arranged such that the pressurizing means includes a heat insulating structure in the contact portion, and the fixing device further includes heating means for heating the surface of the fixing means, the first temperature detection means for detecting the surface temperature of the fixing means in a vicinity of the contact portion, the first temperature detection means being provided in a vicinity of the contact portion of the fixing means, the second temperature detection means for detecting the surface temperature of the pressurizing means in a vicinity of the contact portion, the second temperature detection means being provided in a vicinity of the contact portion of the pressurizing means, and heat control means for controlling the heating means based on an output from the first temperature detection means and the second temperature detection means, wherein the heat control means controls the heating means such that the surface temperature of the fixing means and the surface temperature of the pressurizing means at the contact portion fall within a non-offset region defined by critical border lines obtained from the function of the surface temperature of the fixing means and the surface temperature of the pressurizing means, the critical border lines including (a) the first critical line indicative of the temperature of the interface between the recording material and the toner, which offers sufficient fixing strength between the toner and the recording material and (b) the second critical border line indicative of the critical temperature between the fixing means and the toner at which high temperature offset does not occur.

According to the described arrangement, by controlling the surface temperature of the fixing means and the surface temperature of the pressurizing means within the non-offset region, an occurrence of the offset can be prevented without using the offset prevention use oil, and a fixing inferior of the toner can be reduced.

The described fixing device may be arranged so as to further include moving means for moving the pressurizing means so as to be in contact with and separated from the fixing means, and recording material detection means for detecting the recording material, the recording material detection means being provided in the upstream side in the transport direction of the recording material than the pressurizing means, wherein the pressurizing means is supported by the fixing means so as to be capable of moving to be in contact with and separated from the fixing means such that the pressurizing means contacts the fixing means when the recording material is detected by the recording material detection means.

According to the described arrangement, the period in which the fixing means and the pressuring means are directly contact with each other without having a recording material in-between such as the wait time for transporting the recording material, etc., can be reduced, and an amount of heat transferred from the fixing means to the pressurizing means in the contact portion can be reduced. Therefore, according to the described arrangement, a rise in temperature of the pressurizing means can be suppressed, and the pressurizing means pressurizes the fixing means only when necessary, and a permanent deformation of the fixing means under an applied pressure can be prevented.

In each of the described arrangement, it may be arranged so as to further include rotation start control means for controlling the fixing means and the pressurizing means so as to start rotating when the surface temperature of the fixing means as detected by the first temperature detection means reaches a predetermined temperature.

In the described structure, for example, it can be arranged such that the pressurizing means includes at least one pressurizing roller made of a heat insulating material which is parallelly placed with the fixing means and at least one pressurizing belt support roller placed outside the contact potion and a pressurizing belt stretched to the outside of the contact portion by the pressurizing roller and the pressurizing belt support roller.

The fixing device having the described arrangement offers a wide permissible temperature range for the fixing roller within the non-offset region, and can manage variations in environmental temperature. Therefore, the fixing device can be suitably applied for the fixing method of the present invention.

For the heat insulating material, for example, a foam elastic material may be used.

In the case where the heat insulating material is constituted by the foam elastic material, the heat insulating material shows excellent heat insulating properties by air foams contained in the elastic member. Therefore, in the case where the heat insulating material is constituted by foam elastic member, transfer of the heat to the pressurizing roller or the storage of heat can be still suppressed, and a temperature rise of the pressurizing belt due to the contact with the fixing roller can be effectively suppressed. Moreover, as the an amount of heat transferred from the fixing roller to the pressurizing roller is small, a warm-up time can be still reduced.

It may be arranged such that the pressurizing belt is stretched in the transport direction of the recording material to the upstream side in the transport direction of the recording material.

According to the described arrangement, the recording material can be pre-heated utilizing the releasing of heat, a fixing roller can be formed at a lower temperature of the fixing roller. Additionally, by the effects of absorbing heat from the recording material, a rise in temperature of the pressurizing belt can be suppressed.

According to the described arrangement, as the fixing means and the pressurizing means stop rotating during the warm-up time until the surface of the fixing means is heated to temperatures at which a fixing operation can be. Therefore, when adopting the heat insulating material for the pressurizing means, even if the fixing means is heated during the warm-up time, compared with the arrangement wherein these means rotate, an amount of heat transferred from the fixing means to the pressuring means can be reduced, thereby reducing the warm-up time.

Each of the described structures may be arranged so as to further include recording material absorption means for absorbing a recording material onto the surface of the pressurizing belt, wherein the pressurizing belt functions as the recording material transport means for transporting the recording material having a toner image formed thereon to the contact portion by the recording material absorption means while being attracted to the surface of the pressurizing belt.

According to the described arrangement, as the recording material can be transported while being attracted onto the surface of the pressurizing belt, the recording material can absorb heat from the pressurizing belt for sure. As a result, improved effects of suppressing a temperature rise of the pressurizing belt can be achieved.

It is preferable that at least one of the pressurizing belt support rollers be made of a metal material.

According to the described arrangement, as the pressurizing belt support roller is made of a metal material of a large heat capacity, the heat of the pressurizing belt can be temporarily absorbed by the pressurizing belt support roller, and the heat can be released during the wait time for the fixing operation. Therefore, according to the described arrangement, a temperature rise of the pressurizing endless belt can be reduced.

It may be also arranged such that at least one of the pressurizing belt support rollers is a heat pipe, and the fixing device further includes a cooling fan for cooling off the heat pipe.

According to the described arrangement, as the heat as stored on the pressurizing belt can be cooled off via the heat pipe, the pressurizing belt can be cooled, and a rise in temperature of the pressurizing belt can be reduced. Additionally, by controlling the surface temperature of the fixing roller and the surface temperature of the pressurizing belt to fall within the non-offset region, the surface temperature of the pressurizing belt can be reduced, and the above surface temperatures can be controlled with ease.

In each of the described arrangement, a thin belt of a laminated structure wherein a release material is laminated on the heat-resisting material may be adopted for the pressurizing belt.

According to the described arrangement, as a large effect of releasing heat from the surface of the belt can be obtained, a rise in temperature of the pressurizing belt can be reduced.

The invention being thus described, it will be obvious that the same may be varied in many ways. Such variations are not to be regarded as a departure from the spirit and scope of the invention, and all such modification as would be obvious to one skilled in the art are intended to be included within the scope of the following claims.

What is claimed is:

1. A fixing method for fixing an unfixed toner image formed on a recording material by transporting a recording material having formed thereon an unfixed toner image to a contact portion between fixing means and pressurizing means for pressurizing a surface of said fixing means, comprising the steps of:

(i) obtaining beforehand a non-offset region defined by a critical border line obtained from a function of a fixing means surface temperature and a pressurizing means surface temperature in which a sufficient fixing strength for fixing toner onto the recording material can be ensured without generating a high temperature offset; and (ii) controlling the fixing means surface temperature and the pressurizing means surface temperature at the contact portion while the recording material is being transported therethrough to fall within the non-offset region.

2. The fixing method as set forth in claim 1, wherein:

said critical border line includes at least a first critical border line indicating temperatures of an interface between the recording material and the toner which offer sufficient fixing strength for fixing the toner onto the recording material, and a second critical border line indicating temperatures of an interface between said fixing means and the toner at which a high temperature offset does not occur.

3. The fixing method as set forth in claim 2, wherein:

said critical border line further includes a third critical border line indicting temperatures at which thermal durability of said fixing means is guaranteed.

4. The fixing method as set forth in claim 2, wherein:

the fixing means surface temperature and the pressurizing means surface temperature at the contact portion while the recording material is being transported therethrough are controlled to be around a center line between the first critical border line and the second critical border line.

5. The fixing method as set forth in claim 1, wherein:

said pressurizing means is made of a heat insulating material.

6. The fixing method as set forth in claim 5, wherein said step (ii) includes the steps of:

measuring the fixing means surface temperature and the pressurizing means surface temperature; and controlling heat application to said fixing means based on the fixing means surface temperature and the pressurizing means surface temperature.

7. The fixing method as set forth in claim 1, further including the step of:

separating said pressurizing means from said fixing means when the recording material is not transported through the contact portion.

8. The fixing method as set forth in claim 5, further comprising the step of:

controlling said fixing means and said pressurizing means so as to start rotating when the fixing means surface temperature is detected to be ready for a fixing operation.

9. A fixing device comprising:

fixing means;

pressurizing means for pressurizing a surface of said fixing means;

heating means for heating said fixing means;

first temperature detection means for detecting a surface temperature of said fixing means in a vicinity of the contact portion, said first temperature detection means being provided in a vicinity of the contact portion of said fixing means;

second temperature detection means for detecting a surface temperature of said pressurizing means in a vicinity of the contact portion, said second detection means being provided in a vicinity of the contact portion of said pressurizing means; and heat application control means for controlling said heating means based on results of detection by said first temperature detection means and said second temperature detection means, wherein said heat application control means controls the fixing means surface temperature and the pressurizing means surface temperature at the contact portion while the recording material is being transported therethrough within a non-offset region in which a sufficient fixing strength for fixing toner onto the recording material can be ensured without generating a high temperature offset, said non-offset region being defined by a critical border line obtained from a function of a fixing means surface temperature and a pressurizing means surface temperature.

10. The fixing device as set forth in claim 9, wherein:

said critical border line includes at least a first critical border line indicating temperatures of an interface between the recording material and the toner which offer sufficient fixing strength for fixing the toner onto the recording material, and a second critical border line indicating temperatures of an interface between said fixing means and the toner at which a high temperature offset does not occur.

11. The fixing device as set forth in claim 10, wherein:

said critical border line further includes a third critical border line indicting temperatures at which thermal durability of said fixing means is guaranteed.

12. The fixing device as set forth in claim 9, wherein:

said pressurizing means includes a heat-insulating material.

13. The fixing device as set forth in claim 9, further comprising:

moving means for moving said pressurizing means to be in contact with and separated from said fixing means.

14. The fixing device as set forth in claim 13, further comprising:

recording material detection means for detecting the recording material, said recording material detection means being provided in an upstream side in a transport direction of the recording material, wherein said moving means makes the fixing means and the pressurizing means in contact with each other upon detecting the recording material by said recording material detection means.

15. The fixing device as set forth in claim 13, wherein:

said pressurizing means is supported so as to be movable to be in contact with and separated from said fixing means being fixed.

16. The fixing device as set forth in claim 9, further comprising:

rotation start control means for controlling said fixing means and said pressurizing means so as to start rotating when the fixing means surface temperature as detected by said first temperature detection means reaches a temperature to be ready for a fixing operation.

17. The fixing device as set forth in claim 9, wherein said pressurizing means includes:

at least one pressurizing roller made of an insulating material, said pressurizing roller being parallely provided with said fixing means so as to pressurize a surface of said fixing means and at least one pressurizing belt support roller being provided outside of the contact portion, and a pressurizing belt being stretched to the outside of the contact portion by said pressurizing roller and said pressurizing belt support roller.

18. The fixing device as set forth in claim 12, wherein:

said heat-insulating material is a foam elastic member.

19. The fixing device as set forth in claim 17, wherein:

said pressurizing belt is stretched in the transport direction of the recording material to an upstream side of the contact portion in the transport direction of the recording material.

20. The fixing device as set forth in claim 17, further comprising:

recording material attraction means for attracting the recording material onto the surface of the pressurizing belt, wherein said pressurizing belt functions also as recording material transport means for transporting the recording material having formed thereon an unfixed toner image to the contact portion while being attracted onto the surface of said pressurizing belt.

21. The fixing device as set forth in claim 17, wherein:

at least one of said pressurizing belt support rollers is made of a metal material.

22. The fixing device as set forth in claim 17, wherein:

at least one pressurizing belt support roller is a heat pipe, and a cooling fan is provided for cooling said heat pipe.

23. The fixing device as set forth in claim 14, wherein:

said pressurizing belt is a thin film of a laminated structure wherein a release material is laminated onto the heat insulating material.

24. A fixing method for fixing an unfixed toner image onto a recording material by transporting the recording material having formed thereon an unfixed toner image to a contact portion between fixing means and pressurizing means for pressurizing a surface of said fixing means, wherein:

a fixing means surface temperature and a pressurizing means surface temperature are controlled to fall within a non-offset region defined by a critical border line obtained by a function of the fixing means surface temperature and the pressurizing means fixing temperature, said critical border line including at least a first critical border line indicating temperatures of an interface between the recording material and the toner at which sufficient fixing strength for fixing the toner onto the recording material can be ensured, and a second critical border line indicating temperatures of an interface between said fixing means and the toner at which a high temperature offset does not occur.

* * * * *